US011524298B2

(12) United States Patent
Soto-Moreno et al.

(10) Patent No.: US 11,524,298 B2
(45) Date of Patent: Dec. 13, 2022

(54) DIGITAL MICROFLUIDICS DEVICES AND METHODS OF USE THEREOF

(71) Applicant: MIROCULUS INC., San Francisco, CA (US)

(72) Inventors: Jorge Abraham Soto-Moreno, San Francisco, CA (US); Gregory Arthur Ray, San Francisco, CA (US); Foteini Christodoulou, San Francisco, CA (US)

(73) Assignee: mirOculus Inc., San Francisco, CA (US)

( * ) Notice: Subject to any disclaimer, the term of this patent is extended or adjusted under 35 U.S.C. 154(b) by 0 days.

(21) Appl. No.: 17/630,048

(22) PCT Filed: Jul. 27, 2020

(86) PCT No.: PCT/US2020/043675
§ 371 (c)(1),
(2) Date: Jan. 25, 2022

(87) PCT Pub. No.: WO2021/016614
PCT Pub. Date: Jan. 28, 2021

(65) Prior Publication Data

US 2022/0297129 A1 Sep. 22, 2022

Related U.S. Application Data

(60) Provisional application No. 62/878,689, filed on Jul. 25, 2019.

(51) Int. Cl.
*B01L 3/00* (2006.01)

(52) U.S. Cl.
CPC ..... *B01L 3/502792* (2013.01); *B01L 2200/04* (2013.01); *B01L 2200/147* (2013.01);
(Continued)

(58) Field of Classification Search
CPC ..... B01L 3/502792; B01L 2200/04; B01L 2200/147; B01L 2300/168;
(Continued)

(56) References Cited

U.S. PATENT DOCUMENTS 4,489,863 A 9/1984 Ts'o et al.
4,569,575 A 2/1986 Le Pesant et al.
(Continued)

FOREIGN PATENT DOCUMENTS

CA 2470847 A1 7/2003
CA 2740113 A1 4/2010
(Continued)

OTHER PUBLICATIONS

Miralles, Vincent et al. "A Review of Heating and Temperature Control in Microfluidic Systems: Techniques and Applications." Diagnostics (2013) 3 33-67. (Year: 2013).*
(Continued)

*Primary Examiner* — Christopher Adam Hixson
(74) *Attorney, Agent, or Firm* — Shay Glenn LLP

(57) ABSTRACT

Digital microfluidic (DMF) apparatuses and methods for optically-induced heating and manipulating droplets are described herein. DMF apparatuses employing photonic heating as described herein provide radical simplification of routing droplets/reagents in complex, multistep protocols and/or highly plexed workflows.

22 Claims, 8 Drawing Sheets

(52) U.S. Cl.
CPC . *B01L 2300/168* (2013.01); *B01L 2300/1861* (2013.01); *B01L 2300/1894* (2013.01); *B01L 2400/0427* (2013.01)

(58) Field of Classification Search
CPC ..... B01L 2300/1861; B01L 2300/1894; B01L 2400/0427
See application file for complete search history.

(56) References Cited

U.S. PATENT DOCUMENTS 4,636,785 A 1/1987 Le Pesant
4,818,052 A 4/1989 Le Pesant et al.
5,034,506 A 7/1991 Summerton et al.
5,130,238 A 7/1992 Malek et al.
5,216,141 A 6/1993 Benner
5,235,033 A 8/1993 Summerton et al.
5,270,185 A 12/1993 Margolskee
5,386,023 A 1/1995 Sanghvi et al.
5,399,491 A 3/1995 Kacian et al.
5,409,818 A 4/1995 Davey et al.
5,411,876 A 5/1995 Bloch et al.
5,455,166 A 10/1995 Walker
5,486,337 A 1/1996 Ohkawa
5,602,240 A 2/1997 De Mesmaeker et al.
5,637,684 A 6/1997 Cook et al.
5,644,048 A 7/1997 Yau
5,681,702 A 10/1997 Collins et al.
5,705,365 A 1/1998 Ryder et al.
5,710,029 A 1/1998 Ryder et al.
5,888,779 A 3/1999 Kacian et al.
6,007,690 A 12/1999 Nelson et al.
6,074,725 A 6/2000 Kennedy
6,294,063 B1 9/2001 Becker et al.
6,352,838 B1 3/2002 Krulevitch et al.
6,401,552 B1 6/2002 Elkins
6,495,369 B1 12/2002 Kercso et al.
6,565,727 B1 5/2003 Shenderov
6,596,988 B2 7/2003 Corso et al.
6,723,985 B2 4/2004 Schultz et al.
6,773,566 B2 8/2004 Shenderov
6,787,111 B2 9/2004 Roach et al.
6,887,384 B1 5/2005 Frechet et al.
6,911,132 B2 6/2005 Pamula et al.
6,989,234 B2 1/2006 Kolar et al.
7,057,031 B2 6/2006 Olejnik et al.
7,147,763 B2 12/2006 Elrod et al.
7,163,612 B2 1/2007 Sterling et al.
7,214,302 B1 5/2007 Reihs et al.
7,323,345 B1 1/2008 Sijemnstrom
7,328,979 B2 2/2008 Decre et al.
7,329,545 B2 2/2008 Pamula et al.
7,349,014 B2 3/2008 Higashihara
7,390,463 B2 6/2008 He et al.
7,391,020 B2 6/2008 Bousse et al.
7,439,014 B1 10/2008 Pamula et al.
7,445,926 B2 11/2008 Mathies et al.
7,531,120 B2 5/2009 Van Rijn et al.
D599,832 S 9/2009 Chapin et al.
7,713,456 B2 5/2010 Dodd et al.
7,727,723 B2 6/2010 Pollack et al.
7,745,207 B2 6/2010 Jovanovich et al.
7,763,471 B2 7/2010 Pamula et al.
7,815,871 B2 10/2010 Pamula et al.
7,816,121 B2 10/2010 Pollack et al.
7,822,510 B2 10/2010 Paik et al.
7,851,184 B2 12/2010 Pollack et al.
7,897,737 B2 3/2011 Wu et al.
7,901,947 B2 3/2011 Pollack et al.
7,919,330 B2 4/2011 de Guzman et al.
7,939,021 B2 5/2011 Smith et al.
7,998,436 B2 8/2011 Pollack et al.
8,007,739 B2 8/2011 Pollack et al.
8,041,463 B2 10/2011 Pollack et al.
8,053,239 B2 11/2011 Wheeler et al.
8,088,578 B2 1/2012 Hua et al.
8,093,062 B2 1/2012 Winger
8,137,917 B2 3/2012 Pollack et al.
8,187,864 B2 5/2012 Wheeler et al.
8,190,371 B2 5/2012 Allawi et al.
8,202,686 B2 6/2012 Pamula et al.
8,202,736 B2 6/2012 Mousa et al.
8,208,146 B2 6/2012 Srinivasan et al.
8,268,246 B2 9/2012 Srinivasan et al.
8,304,253 B2 11/2012 Yi et al.
8,317,990 B2 11/2012 Pamula et al.
8,349,276 B2 1/2013 Pamula et al.
8,364,315 B2 1/2013 Sturmer et al.
8,367,370 B2 2/2013 Wheeler et al.
8,389,297 B2 3/2013 Pamula et al.
8,394,641 B2 3/2013 Winger
8,399,222 B2 3/2013 Siva et al.
8,426,213 B2 4/2013 Eckhardt et al.
8,440,392 B2 5/2013 Pamula et al.
8,454,905 B2 6/2013 Pope et al.
8,460,528 B2 6/2013 Pollack et al.
8,470,153 B2 6/2013 Feiglin et al.
8,470,606 B2 6/2013 Srinivasan et al.
8,481,125 B2 7/2013 Yi et al.
8,492,168 B2 7/2013 Srinivasan et al.
8,562,807 B2 10/2013 Srinivasan et al.
8,591,830 B2 11/2013 Sudarsan et al.
8,592,217 B2 11/2013 Eckhardt
8,613,889 B2 12/2013 Pollack et al.
8,637,317 B2 1/2014 Pamula et al.
8,637,324 B2 1/2014 Pollack et al.
8,653,832 B2 2/2014 Hadwen et al.
8,658,111 B2 2/2014 Srinivasan et al.
8,685,344 B2 4/2014 Sudarsan et al.
8,685,754 B2 4/2014 Pollack et al.
8,702,938 B2 4/2014 Srinivasan et al.
8,716,015 B2 5/2014 Pollack et al.
8,809,068 B2 8/2014 Sista et al.
8,821,705 B2 9/2014 Bjomson et al.
8,845,872 B2 9/2014 Pollack et al.
8,846,414 B2 9/2014 Sista et al.
8,852,952 B2 10/2014 Pollack et al.
8,872,527 B2 10/2014 Sturmer et al.
8,877,512 B2 11/2014 Srinivasan et al.
8,888,969 B2 11/2014 Soleymani et al.
8,901,043 B2 12/2014 Eckhardt et al.
8,926,065 B2 1/2015 Winger
8,927,296 B2 1/2015 Sista et al.
8,936,708 B2 1/2015 Feiglin
8,951,732 B2 2/2015 Pollack et al.
8,980,198 B2 3/2015 Srinivasan et al.
9,005,544 B2 4/2015 Van Dam et al.
9,011,662 B2 4/2015 Wang et al.
9,039,973 B2 5/2015 Watson et al.
9,046,514 B2 6/2015 Sista et al.
9,091,649 B2 7/2015 Pollack et al.
9,140,635 B2 9/2015 Graham et al.
9,188,615 B2 11/2015 Sturmer et al.
9,223,317 B2 12/2015 Winger
9,238,222 B2 1/2016 Delattre et al.
9,248,450 B2 2/2016 Bauer
9,377,439 B2 6/2016 Lee et al.
9,435,765 B2 9/2016 Reimitz et al.
9,446,404 B2 9/2016 Bauer et al.
9,476,811 B2 10/2016 Mudrik et al.
9,476,856 B2 10/2016 Pamula et al.
9,513,253 B2 12/2016 Winger
9,517,469 B2 12/2016 Shenderov et al.
9,594,056 B2 3/2017 Fobel et al.
9,851,365 B2 12/2017 Mousa et al.
10,232,374 B2 3/2019 Jebrail et al.
10,464,067 B2 11/2019 Jebrail et al.
10,596,572 B2 3/2020 Hong et al.
10,695,762 B2 6/2020 Jebrail et al.
11,097,276 B2 8/2021 Jebrail et al.
11,253,860 B2 2/2022 Jebrail et al.
11,298,700 B2 4/2022 Hong et al.
2002/0150683 A1 10/2002 Troian et al.
2003/0017551 A1 1/2003 Parthasarathy et al.

(56) References Cited

U.S. PATENT DOCUMENTS

2003/0136451 A1 7/2003 Beebe et al.
2003/0194716 A1 10/2003 Knoll
2004/0171169 A1 9/2004 Kallury et al.
2004/0211659 A1 10/2004 Velev
2005/0115836 A1 6/2005 Reihs
2005/0133370 A1 6/2005 Park et al.
2005/0148091 A1 7/2005 Kitaguchi et al.
2005/0191759 A1 9/2005 Bjergaard et al.
2005/0220675 A1 10/2005 Reed et al.
2006/0091015 A1 5/2006 Lau
2006/0132542 A1 6/2006 Bruker et al.
2006/0231398 A1 10/2006 Sarrut et al.
2006/0272942 A1 12/2006 Sirringhaus
2007/0023292 A1 2/2007 Kim et al.
2007/0095407 A1 5/2007 Chen et al.
2007/0148763 A1 6/2007 Huh et al.
2007/0269825 A1 11/2007 Wang et al.
2008/0110753 A1 5/2008 Fourrier et al.
2008/0131904 A1 6/2008 Parce et al.
2008/0156983 A1 7/2008 Fourrier et al.
2008/0169197 A1 7/2008 McRuer et al.
2008/0185339 A1 8/2008 Delaplerre et al.
2008/0210558 A1 9/2008 Sauter-Starace et al.
2008/0241831 A1 10/2008 Fan et al.
2008/0293051 A1 11/2008 Levy et al.
2009/0017197 A1 1/2009 Zhang et al.
2009/0017453 A1 1/2009 Maples et al.
2010/0022414 A1 1/2010 Link et al.
2010/0025250 A1 2/2010 Pamula et al.
2010/0032293 A1 2/2010 Pollack et al.
2010/0048410 A1 2/2010 Shenderov et al.
2010/0087012 A1 4/2010 Shenderov
2010/0120130 A1 5/2010 Srinivasan et al.
2010/0130369 A1 5/2010 Shenderov et al.
2010/0136544 A1 6/2010 Agresti et al.
2010/0206094 A1 8/2010 Shenderov
2010/0236927 A1 9/2010 Pope et al.
2010/0236928 A1 9/2010 Srinivasan et al.
2010/0236929 A1 9/2010 Pollack et al.
2010/0270156 A1 10/2010 Srinivasan et al.
2010/0288368 A1 11/2010 Beebe et al.
2010/0311599 A1 12/2010 Wheeler et al.
2011/0024793 A1 2/2011 Jeon
2011/0076685 A1 3/2011 Moeller et al.
2011/0097763 A1 4/2011 Pollack et al.
2011/0104725 A1 5/2011 Pamula et al.
2011/0104747 A1 5/2011 Pollack et al.
2011/0107822 A1 5/2011 Bunner et al.
2011/0147216 A1 6/2011 Fan et al.
2011/0240471 A1 10/2011 Wheeler et al.
2011/0247934 A1 10/2011 Wang et al.
2011/0293851 A1 12/2011 Bollström et al.
2011/0303542 A1 12/2011 Srinivasan et al.
2011/0311980 A1 12/2011 Pollack et al.
2012/0000777 A1 1/2012 Garrell et al.
2012/0045748 A1 2/2012 Willson et al.
2012/0045768 A1 2/2012 Arunachalam et al.
2012/0149018 A1 6/2012 Dahlberg et al.
2012/0190027 A1 7/2012 Loeffert et al.
2012/0208705 A1 8/2012 Steemers et al.
2012/0208724 A1 8/2012 Steemers et al.
2012/0259233 A1 10/2012 Chan et al.
2012/0261264 A1 10/2012 Srinivasan et al.
2012/0289581 A1 11/2012 Chang et al.
2012/0325665 A1 12/2012 Chiou et al.
2013/0017544 A1 1/2013 Eckhardt et al.
2013/0018611 A1 1/2013 Stumter
2013/0062205 A1 3/2013 Hadwen et al.
2013/0068622 A1 3/2013 Schertzer et al.
2013/0105318 A1 5/2013 Bhattacharya et al.
2013/0123979 A1 5/2013 Elliot et al.
2013/0157259 A1 6/2013 Choi et al.
2013/0168250 A1 7/2013 Fogleman et al.
2013/0171546 A1 7/2013 White et al.
2013/0177915 A1 7/2013 Too et al.
2013/0203606 A1 8/2013 Pollack et al.
2013/0215492 A1 8/2013 Steckl et al.
2013/0217113 A1 8/2013 Srinivasan et al.
2013/0225450 A1 8/2013 Pollack et al.
2013/0270114 A1 10/2013 Feiglin
2013/0284956 A1 10/2013 Kwon
2013/0288254 A1 10/2013 Pollack et al.
2013/0293246 A1 11/2013 Pollack et al.
2013/0306480 A1 11/2013 Chang et al.
2014/0005066 A1 1/2014 Boles et al.
2014/0054174 A1 2/2014 Wang
2014/0124037 A1 5/2014 Foley
2014/0141409 A1 5/2014 Foley et al.
2014/0161686 A1 6/2014 Bort et al.
2014/0174926 A1 6/2014 Bort et al.
2014/0179539 A1 6/2014 Lohman et al.
2014/0194305 A1 7/2014 Kayyem et al.
2014/0216559 A1 8/2014 Foley
2014/0273100 A1 9/2014 Saito et al.
2014/0335069 A1 11/2014 Graham et al.
2015/0001078 A1 1/2015 Feiglin
2015/0021182 A1 1/2015 Rival et al.
2015/0075986 A1 3/2015 Cyril et al.
2015/0111237 A1 4/2015 Graham et al.
2015/0144489 A1 5/2015 Hoffmeyer et al.
2015/0148549 A1 5/2015 Van Dam et al.
2015/0205272 A1 7/2015 Yi et al.
2015/0212043 A1 7/2015 Pollack
2015/0258520 A1 9/2015 Griffiths et al.
2015/0267242 A1 9/2015 Foegeding et al.
2016/0068901 A1 3/2016 Eckhardt et al.
2016/0108432 A1 4/2016 Punnamaraju et al.
2016/0116438 A1 4/2016 Pamula et al.
2016/0129437 A1 5/2016 Kayyem et al.
2016/0161343 A1 6/2016 Smith et al.
2016/0175859 A1 6/2016 Yi et al.
2016/0199832 A1 7/2016 Jamshidi et al.
2016/0298173 A1 10/2016 Wang et al.
2016/0319354 A1 11/2016 Tocigl et al.
2016/0370317 A9 12/2016 Sudarsan et al.
2017/0184546 A1 6/2017 Fobel et al.
2017/0315090 A1 11/2017 Wheeler et al.
2017/0354973 A1 12/2017 Sustarich et al.
2018/0001286 A1 1/2018 Wu
2018/0095067 A1 4/2018 Huff et al.
2018/0099275 A1 4/2018 Wu et al.
2018/0120335 A1 5/2018 Mousa et al.
2018/0221882 A1* 8/2018 Roberts ..... G01N 27/44704
2018/0250672 A1 9/2018 Jamshidi et al.
2019/0168223 A1 6/2019 Soto-Moreno et al.
2019/0210026 A1 7/2019 Jebrail et al.
2020/0114359 A1 4/2020 Jebrail et al.
2020/0179933 A1 6/2020 Jebrail et al.
2020/0316606 A1 10/2020 Soto-Moreno et al.
2020/0324290 A1 10/2020 Jebrail et al.
2021/0069714 A1 3/2021 Jebrail et al.
2021/0370304 A1 12/2021 Jebrail et al.

FOREIGN PATENT DOCUMENTS

CN 1668527 A 9/2005
CN 101609063 A 12/2009
CN 102549804 A 7/2012
CN 102719526 A 10/2012
CN 102836653 A 12/2012
CN 103014148 A 4/2013
CN 103170383 A 6/2013
CN 104321141 A 1/2015
CN 105849032 A 8/2016
CN 106092865 A 11/2016
DE 19949735 A1 5/2001
EP 2111554 B1 5/2013
GB 2533952 A 7/2016
JP 2002321449 A 11/2002
JP 2006220606 A 8/2006
JP 2010500596 A 1/2010
JP 2010098133 A 4/2010
JP 2010515877 A 5/2010
JP 2010180222 A 8/2010

(56) References Cited

FOREIGN PATENT DOCUMENTS

| | | | |
|---|---|---|---|
| JP | 2012525687 | A | 10/2012 |
| WO | WO2000/067907 | A2 | 11/2000 |
| WO | WO2001/025137 | A1 | 4/2001 |
| WO | WO2003/045556 | A2 | 6/2003 |
| WO | WO2004/074169 | A1 | 9/2004 |
| WO | WO2005/068993 | A1 | 7/2005 |
| WO | WO2005/118129 | A1 | 12/2005 |
| WO | WO2006/000828 | A2 | 1/2006 |
| WO | WO2006/102309 | A2 | 9/2006 |
| WO | WO2007/120240 | A2 | 10/2007 |
| WO | WO2007/123908 | A2 | 11/2007 |
| WO | WO2007/130294 | A2 | 11/2007 |
| WO | WO2007/136386 | A2 | 11/2007 |
| WO | WO2008/066828 | A2 | 6/2008 |
| WO | WO2009/026339 | A2 | 2/2009 |
| WO | WO2009/052348 | A2 | 4/2009 |
| WO | WO2009/111723 | A1 | 9/2009 |
| WO | WO2009/111769 | A2 | 9/2009 |
| WO | WO2009/140671 | A2 | 11/2009 |
| WO | WO2010/003188 | A1 | 1/2010 |
| WO | WO2010/006166 | A2 | 1/2010 |
| WO | WO2010/027894 | A2 | 3/2010 |
| WO | WO2010/042637 | A2 | 4/2010 |
| WO | WO2010/069977 | A1 | 6/2010 |
| WO | WO2010/091334 | A2 | 8/2010 |
| WO | WO2010/111265 | A1 | 9/2010 |
| WO | WO2011/002957 | A2 | 1/2011 |
| WO | WO2011/062557 | A1 | 5/2011 |
| WO | WO2012/061832 | A1 | 5/2012 |
| WO | WO2012/172172 | A1 | 12/2012 |
| WO | WO2013/006312 | A2 | 1/2013 |
| WO | WO2013/040562 | A2 | 3/2013 |
| WO | WO2013/090889 | A1 | 6/2013 |
| WO | WO2013/096839 | A1 | 6/2013 |
| WO | WO2013/116039 | A1 | 8/2013 |
| WO | WO2013/176767 | A1 | 11/2013 |
| WO | WO2014/078100 | A1 | 5/2014 |
| WO | WO2014/100473 | A1 | 6/2014 |
| WO | WO2014/106167 | A1 | 7/2014 |
| WO | WO2014/108185 | A1 | 7/2014 |
| WO | WO2014/183118 | A1 | 11/2014 |
| WO | WO2015/023745 | A1 | 2/2015 |
| WO | WO2015/172255 | A1 | 11/2015 |
| WO | WO2015/172256 | A1 | 11/2015 |
| WO | WO2016/128544 | A1 | 8/2016 |
| WO | WO2016/182814 | A2 | 11/2016 |
| WO | WO2016/197013 | A1 | 12/2016 |
| WO | WO2017/223026 | A1 | 12/2017 |
| WO | WO2018/119253 | A1 | 6/2018 |
| WO | WO2018/126082 | A1 | 7/2018 |
| WO | WO2019/023133 | A1 | 1/2019 |
| WO | WO2019/046860 | A1 | 3/2019 |
| WO | WO2019/075211 | A1 | 4/2019 |
| WO | WO2019/226919 | A1 | 11/2019 |
| WO | WO2020/160520 | A1 | 8/2020 |
| WO | WO2020/176816 | A8 | 9/2020 |
| WO | WO2021/016614 | A1 | 1/2021 |
| WO | WO2021/092325 | A1 | 5/2021 |
| WO | WO2021/173621 | | 9/2021 |

OTHER PUBLICATIONS

Abdelgawad et al., All-terrain droplet actuation, Lab on a Chip, 8(5), pp. 672-677, May 2008.

Abdelgawad et al.; Low-cost, rapid-prototyping of digital microfluidics devices, Microfluidics and Nanofluidics, 4, pp. 349-355, Apr. 2008.

Abdelgawad et al.; Rapid prototyping in copper substrates for digital microfluidics, Adv. Mater., 19(1), pp. 133-137; Jan. 2007.

Abdelgawad et al.; Hybrid microfluidics: a digital-to-channel interface for in-line sample processing and chemical separations, Lab on a Chip, 9(8), pp. 1046-1051, Apr. 2009.

Abdelgawad; Digital Microfluidics for Integration of Lab-on -a-Chip Devices (Doctoral dissertation); University of Toronto; © 2009.

Albrecht et al.; Laboratory testing of gonadal steroids in children; Pediatric Endocrinology Reviews; 5(suppl 1); pp. 599-607; Oct. 2007.

Analog Devices; 24-bit Capicitance-to-Digital converter with temperature sensor, AD7745/AD7746; Analog Devices; Norwood, MA; 28 pages; (the year of publication is sufficiently earlier than the effective U.S. filing date and any foreign priority date so that the particular month of publication is not in issue) 2005.

Analog Devices; Extending the capacitive input range of AD7745/AD7746 Capicitance-to-Digital converter; Analog Devices; Norwood, MA; 5 pages; (the year of publication is sufficiently earlier than the effective U.S. filing date and any foreign priority date so that the particular month of publication is not in issue) 2009.

Ankarberg-Lindren et al.; A purification step prior to commercial sensitive immunoassay is necessary to achieve clinical usefulness when quantifying serum 17 ?-estradiol in prepubertal children. Eur J Endocrinol, 158, pp. 117-124, Jan. 2008.

Armstrong et al.; A study of plasma free amino acid levels. II. Normal values for children and adults, Metabolism, 22(4), pp. 561-569, Apr. 1973.

Asiello et al.; Miniaturized isothermal nucleic acid amplification, a review; Lab Chip; 11(8); pp. 1420-1430; Apr. 2011.

Au et al., Integrated microbioreactor for culture and analysis of bacteria, algae and yeast, Biomedical Microdevices, 13(1), pp. 41-50, Feb. 2011.

Au et al.; A new angle on pluronic additives: Advancing droplets and understanding in digital microfluidics; Langmuir; 27; pp. 8586-8594; Jun. 2011.

Banatvala et al., Rubella, The Lancet. 363(9415), pp. 1127-1137, Apr. 2004.

Banér et al.; Signal amplification of padlock probes by rolling circle replication; Nuc. Acids Res.; 26(22); pp. 5073-5078; Nov. 1998.

Barany; Genetic disease detection and DNA amplification using cloned thermostable ligase; PNAS; 88(1); pp. 189-193; Jan. 1991.

Barbulovic-Nad et al., A microfluidic platform for complete mammalian cell culture, Lab on a Chip, 10(12), pp. 1536-1542; Jun. 2010.

Barbulovic-Nad et al.; Digital microfluidics for cell-based assays, Lab Chip, 8(4), pp. 519-526; Apr. 2008.

Baxendale et al.; Multistep synthesis using modular flow reactors: bestmann-ohira reagent for the formation of alkynes and triazoles; Angewandle Chemie International Edition; 48(22); pp. 4017-4021; May 2009.

Beattie et al.; Endogenous sex hormones, breast cancer risk, and tamoxifen response: an ancillary study in the NSABP Breast Cancer Prevention Trial P-1, J Natl Cancer Inst, 98(2), pp. 110-115, Jan. 2006.

Beaucage et al., The Functionalization of Oligonucleotides via Phosphoramidite Derivatives,Tetrahedron, 49(10), pp. 1925-1963, Mar. 1993.

Belanger et al.; Omental and subcutaneous adipose tissue steroid levels in obese men. Steroids, 71(8), pp. 674-682, Aug. 2006.

Bergkvist et al., Improved chip design for integrated solid-phase microextraction in on-line proteomic sample preparation, Proteomics, 2(4), pp. 422-429, Apr. 2002.

Bi et al.; Dumbbell probe-mediated cascade isothermal amplification: A novel strategy for label-free detection of microRNAs and its application to real sample assay; Analytica Chimica Acta; 760; pp. 69-74; Jan. 2013.

Blankenstein et al.; Intratumoral levels of estrogens in breast cancer. J Steroid Biochem Mol Biol, 69(1-6), pp. 293-297, Apr.-Jun. 1999.

Bodamer et al.; Expanded newborn screening in Europe, Journal of Inherited Metabolic Disease, 30(4), pp. 439-444, Aug. 2007.

Bohlen et al.; Fluorometric assay of proteins in the nanogram range, Archives of Biochemistry and Biophysics, 155(1), pp. 213-220, Mar. 1973.

Boles et al.;Droplet-Based Pyrosequencing Using Digital Microfluidics; Analytical Chemistry; 83(22); pp. 8439-8447; Oct. 14, 2011.

Bollström et al.; A Multilayer Coated Fiber-Based Substrate Suitable for Printed Functionality; Organic Electronics; 10(5); pp. 1020-1023; Aug. 2009.

(56) References Cited

OTHER PUBLICATIONS

Bonneil et al., Integration of solid-phase extraction membranes for sample multiplexing: Application to rapid protein identification from gel-isolated protein extracts, Electrophoresis, 23(20), pp. 3589-3598, Oct. 2002.
Brassard et al.; Water-oil core-shell droplets for electrowetting-based digital microfluidic devices; Lab Chip; 8(8); pp. 1342-1349; Aug. 2008.
Brill et al., Synthesis of oligodeoxynucleoside phosphorodithioates via thioamidites, J. Am. Chem. Soc., 111(6), pp. 2321-2322, Mar. 1989.
Brivio et al.; Integrated microfluidic system enabling (bio)chemical reactions with on-line MALDI-TOF mass spectrometry, Anal. Chem., 74(16), pp. 3972-3976, Aug. 2002.
Burstein; Aromatase inhibitor-associated arthralgia syndrome. Breast, 16(3), pp. 223-234, Jun. 2007.
Carlsson et al., Screening for genetic mutations, Nature, 380(6571), pp. 207, Mar. 1996.
Chace et al.; A biochemical perspective on the use of tandem mass spectrometry for newborn screening and clinical testing, Clinical Biochemistry, 38(4), pp. 296-309; Apr. 2005.
Chace et al.; Rapid diagnosis of maple syrup urine disease in blood spots from newborns by tandem mass spectrometry, Clinical Chemistry, 41(1), pp. 62-68, Jan. 1995.
Chace et al.; Rapid diagnosis of phenylketonuria by quantitative analysis for phenylalanine and tyrosine in neonatal blood spots by tandem mass spectrometry, Clinical Chemistry, 39(1), pp. 66-71; Jan. 1993.
Chace et al.; Use of tandem mass spectrometry for multianalyte screening of dried blood specimens from newborns, Clinical Chemistry, 49(11), pp. 1797-1817, Nov. 2003.
Chace; Mass spectrometry in newborn and metabolic screening: historical perspective and future directions, Journal of Mass Spectrometry, 44(2), pp. 163-170, Feb. 2009.
Chang et al.; Integrated polymerase chain reaction chips utilizing digital microfluidics; Biomedical Microdevices; 8(3); pp. 215-225; Sep. 2006.
Chatterjee et al.; Droplet-based microfluidics with nonaqueous solvents and solutions, Lab Chip, 6(2), pp. 199-206, Feb. 2006.
Chen et al.; Selective Wettability Assisted Nanoliter Sample Generation via Electrowetting-Based Transportation; Proceedings ofthe 5th International Conference on Nanochannels, Microchannels and Minichannels (ICNMM); Puebla, Mexico; Paper No. ICNMM2007-30184; pp. 147-153; Jun. 18-20, 2007.
Chen et al.; The chemistrode: a droplet-based microfluidic device for stimulation and recording with high temporal, spatial, and chemical resolution; Proceedings of the National Academy of Sciences; 105(44); pp. 16843-16848; Nov. 2004.
Cheng et al., Paper-Based ELISA, Angewandte Chemie, 49(28), pp. 4771-4774, Jun. 2010.
Cheng et al.; Highly Sensitive Determination of microRNA Using Target-Primed and Branched Rolling-Circle Amplification; Angew. Chem.; 121(18); pp. 3318-3322; Apr. 2009.
Chetrite et al.; Estradiol inhibits the estrone sulfatase activity in normal and cancerous human breast tissues. Journal of Steroid Biochemistry and Molecular Biology, 104(3-5), pp. 289-292, May 2007.
Cho et al.; Creating, transporting, cutting, and merging liquid droplets by electrowetting-based actuation for digital microfluidic circuits, J. MEMS 2003, 12(1), pp. 70-80, Feb. 2003.
Choi et al., Automated digital microfluidic platform for magnetic-particle-based immunoassays with optimization by design of experiments, Anal. Chem., 85(20), pp. 9638-9646; Oct. 2013.
Choi et al., Digital Microfluidics, Annu. Rev. Anal. Chem., 5, pp. 413-440, (Epub) Apr. 2012.
Christiansen; Hormone Replacement Therapy and Osteoporosis; Maturitas, 23, Suppl. pp. S71-S76, May 1996.
Chuang et al.; Direct Handwriting Manipulation of Droplets by Self-Aligned Mirror-EWOO Across a Dielectric Sheet; 19th IEEE International Conf. on Micro Electro Mechanical Systems (MEMS); Instanbul, Turkey; pp. 538-541; Jan. 22-26, 2006.
Cipriano et al.; The cost-effectiveness of expanding newborn screening for up to 21 inherited metabolic disorders using tandem mass spectrometry: results from a decision-analytic model, Value in Health, 10(2), pp. 83-97, Mar.-Apr. 2007.
Cooney et al.; Electrowetting droplet microfluidics on a single planar surface, Microfluid. Nanofluid., 2(5), pp. 435-446; Sep. 2006.
Coregenomics; How do SPRI beads work; 31 pages; retrieved from the internet (http://core-genomics.blogspot.com/2012/04/how-do-spri-beads-work.html); Apr. 28, 2012.
Cottam et al.; Accelerated synthesis of titanium oxide nanostructures using microfluidic chips; Lab on a Chip; 7(2); pp. 167-169; Feb. 2007.
Crabtree et al.; Microchip injection and separation anomalies due to pressure effects, Anal. Chem., 73(17), pp. 4079-4086, Sep. 2001.
Cunningham; Testosterone replacement therapy for late-onset hypogonadism. Nature Clinical Practice Urology, 3(5), pp. 260-267, May 2006.
Cuzick; Chemoprevention of breast cancer. Women's Health, 2(6), pp. 853-861, Nov. 2006.
Dahlin el al.; Poly(dimethyisiloxane)-based microchip for two-dimensional solid- phase extraction-capillary electrophoresis with an integrated electrospray emitter tip, Anal. Chem., 77(16), pp. 5356-5363, Aug. 2005.
Dambrot; of microchemistry and molecules: Electronic microfluidic device synthesizes biocompatible probes; 4 pages, retrieved from the internet (https://phys.org/news/2012-01-microchemistry-molecules-electronic-microfluidic-device.html); Jan. 26, 2012.
Danton et al., Porphyrin profiles in blood, urine and faeces by HPLC/electrospray ionization tandem mass spectrometry. Biomedical Chromatography, 20(6-7), pp. 612-621, Jun.-Jul. 2006.
Davoust et al.; Evaporation rate of drop arrays within a digital microfluidic system; Sensors and Actuators B Chemical; 189; pp. 157-164; Dec. 2013.
De Mesmaeker et al.; Comparison of rigid and flexible backbones in antisense oligonucleotides; Bioorganic & Medicinal Chem. Lett; 4(3); pp. 395-398; Feb. 1994.
Deligeorgiev et al.; Intercalating Cyanine Dyes for Nucleic Acid Detection; Recent Pat Mat Sci; 2(1); pp. 1-26; Jan. 2006.
Dempcy et al., Synthesis of a thymidyl pentamer of deoxyribonucleic guanidine and binding studies with DNA homopolynucleotides, Proc. Natl. Acad. Sci., 92(13), pp. 6097-6101, Jun. 1995.
Deng et al.; Rapid determination of amino acids in neonatal blood samples based on derivatization with isobutyl chloroformate followed by solid-phase microextraction and gas chromatography/mass spectrometry. Rapid Communications in Mass Spectrometry, 18(1), pp. 2558-2564, Nov. 2004.
Denneulin et al.; Infra-red assisted sintering of inkjet printed silver tracks on paper substrates; J Nanopart Res; 13(9); pp. 3815-3823; Sep. 2011.
Dibbelt et al.; Determination of natural and synthetic estrogens by radioimmunoassay: Comparison of direct and extraction methods for quantification of estrone in human serum Clinical Laboratory, 44(3), 137-143, Mar. 1998.
Dietzen et al.; National academy of clinical biochemistry laboratory medicine practice guidelines: follow-up testing for metabolic disease identified by expanded newborn screening using tandem mass spectrometry; executive summary, Clinical Chemistry, 55(9), pp. 1615-1626, Sep. 2009.
Diver et al.; Warning on plasma oestradiol measurement. Lancet, 330 (8567), p. 1097, Nov. 1987.
Diving Filho et al.; Simultaneous measurements of free amino acid patterns of plasma, muscle and erythrocytes in healthy human subjects, Clinical Nutrition, 16(6), pp. 299-305, Dec. 1997.
Dixon et al.; An inkjet printed, roll-coated digital microfluidic device for inexpensive, miniaturized diagnostic assays; Lab on a Chip; 16(23); pp. 4560-4568; Nov. 2016.
Djerassi; Chemical birth of the pill. American Journal of Obstetrics and Gynecology, 194(1), pp. 290-298, Jan. 2006.
Dobrowolski et al.; DNA microarray technology for neonatal screening, Acta Paediatrica Suppl. 88(432), pp. 61-64, Dec. 1999.

(56) References Cited

OTHER PUBLICATIONS

Doebler et al.; Continuous-flow, rapid lysis devices far biodefense nucleic acid diagnostic systems; Journal of the Association for Laboratory Automation; 14(3); pp. 119-125; Jun. 2009.
Dong et al.; Highly sensitive multiple microRNA detection based on flourescence quenching of graphene oxide and isothermal strand-displacement polymerase reaction; Anal Chem; 84; pp. 4587-4593; Apr. 2012.
Dryden et al.; Integrated digital microfluidic platform for voltammetric analysis; Analytical Chemistry; 85(18); pp. 8809-8816; Sep. 2013.
Duffy et al.; Rapid prototyping of microfluidic systems in Poly (dimethylsiloxane), Anal. Chem., 70(23), pp. 4974-4984, Dec. 1998.
Edgar et al.; Capillary electrophoresis separation in the presence of an immiscible boundary for droplet analysis, Anal. Chem., 78(19), pp. 6948-6954 (author manuscript, 15 pgs.), Oct. 2006.
Egholm et al., PNA hybridizes to complementary oligonucleotides obeying the Watson-Crick hydrogen-bonding rules, Nature, 365(6446), pp. 566-568, Oct. 1993.
Egholm et al., Recognition of guanine and adenine in DNA by cytosine and thymine containing peptide nucleic acids (PNA), J. Am. Chem. Soc., 114(24), pp. 9677-9678; Nov. 1992.
Ehrmann; Polycystic ovary syndrome. New England Journal of Medicine; 352(12); pp. 1223-1236; Mar. 2005.
Ekstrom et al., Miniaturized solid-phase extraction and sample preparation for MALDI MS using a microfabricated integrated selective enrichment target, Journal of Proteome Research, 5(5), pp. 1071-1081, May 2006.
Ekstrom et al., Polymeric integrated selective enrichment target (ISET) for solid-phase-based sample preparation in MALDI-TOF MS, Journal of Mass Spectrometry, 42(11), pp. 1445-1452, Nov. 2007.
Ekstrom et al.,On-chip microextraction for proteomic sample preparation of in-gel digests, Proteomics, 2(4), pp. 413-421, Apr. 2002.
El-Ali et al.; Cells on chips; NATURE (2006) insight Review; 442(7101); pp. 403-411; Jul. 2006.
Fair; Digital microfiuidics: Is a true lab-on-a-chip possible?; Microfuid. Nanofiuid.; 3(3); pp. 245-281; Jun. 2007.
Falk et al.; Measurement of Sex Steroid Hormones in Breast Adipocytes: Methods and Implications; Cancer Epidemiol Biomarkers Prev; 17(8); pp. 1891-1895; Aug. 2008.
Fan et al.; Cross-scale electric manipulations of cells and droplets by frequency-modulated dielectrophoresis and electrowetting; Lab Chip; 8(8); pp. 1325-1331; Aug. 2008.
Fan et al.; Electrically Programmable Surfaces for Configurable Patterning of Cells; Advanced Materials; 20(8); pp. 1418-1423; Apr. 2008.
Fan et al.; Integrated barcode chips for rapid, multiplexed analysis of proteins in microliter quanties of blood; Nature Biotechnology; 26(12); pp. 1373-1378; 15 pagers (Author Manuscript); Dec. 2008.
Faure et al.; Improved electrochemical detection of a transthyretin synthetic peptide in the nanomolar range with a two-electrode system Integrated in a glass/PDMS microchip; Lab on a Chip; 14(15); pp. 2800-2805, Aug. 2014.
Fobel et al.; DropBot: An open-source digital microfluidic control system with precise control of electrostatic driving force and instantaneous drop velocity measurement; Applied Physics Letters; 102(19); 193513 (5 pgs.); May 2013.
Foote et al., Preconcentration of proteins on microfluidic devices using porous silica membranes, Analytical Chemistry, 77(1), pp. 57-63, Jan. 2005.
Freire et al.; A practical interface for microfiuidics and nanoelectrospray mass spectrometry, Electrophoresis, 29(9), pp. 1836-1843, May 2008.
Fridley et al., Controiied release of dry reagents in porous media for tunable temporal and spatial distribution upon rehydration, Lab Chip, 12(21), pp. 4321-4327 (author manuscript, 14 pgs.), Nov. 2012.
Fu et al., Controlled Reagent Transport in Disposable 2D Paper Networks, Lab. Chip, 10(7), pp. 918-920 (author manuscript, 9 pgs. ), Apr. 2010.
Gao et al.; Unusual conformation of a 3'-thioformacetal linkage in a DNA duplex; J. Biomol. NMR; 4(1); pp. 17-34; Jan. 1994.
Gentili et al.; Analysis of free estrogens and their conjugates in sewage and river waters by solid-phase extraction then liquid chromatography-electrospray-tandem mass spectrometry. Chromatographia 56(1), pp. 25-32, Jul. 2002.
Gerasimova et al.; Fluorometric method for phenylalanine microplate assay adapted for phenylketonuria screening, Clinical Chemistry, 35(10), pp. 2112-2115, Oct. 1989.
Gong et al., All-Electronic Droplet Generation On-Chip With Real-Time Feedback Control for EWOD Digital Microfluidics, Lab Chip, 8(6), pp. 898-906 (author manuscript, 20 pgs.), Jun. 2008.
Gong et al.; Portable digital microfluidics platform with active but disposable lab-on-chip; 17th IEEE International Conference on Micro Electro Mechanical Systems; Maastricht, Netherlands; pp. 355-358; Jan. 24-29, 2004.
Gong et al.; Two-dimensional digital microfluidic system by multilayer printed circuit board, 18th IEEE International Conference on Micro Electro Mechanical Systems (MEMS 2005); IEEE; pp. 726-729; Jan. 30-Feb. 3, 2005.
Goto et al.; Colorimetric detection of loop-mediated isothermal amplification reaction by using hydroxy naphthol blue; Biotechniques; 46(3); pp. 167-172; Mar. 2009.
Gottschlich et al.; Integrated microchip-device for the digestion, separation and postcolumn labeling of proteins and peptides, J. Chromatogr. B, 745(1), pp. 243-249, Aug. 2000.
Govindarajan et al., A low cost point-of-care viscous sample preparation device for molecular diagnosis in the developing world; an example of microfluidic origami, Lab Chip, 12(1), pp. 174-181, Jan. 2012.
Green et al.; Neonatal screening by DNA microarray: spots and chips, Nature Reviews Genetics, 6(2), pp. 147-151, Feb. 2005.
Hatch et al., Integrated preconcentraiion SDS-Page of proteins in microchips using photopatterned cross-linked polyacrylamide gels, Analytical Chemistry, 78(14), pp. 4976-4984, Jul. 2006.
He et al. (ed); Food microbiological inspection technology; Chapter 5: Modern food microbiological inspection technology: China Quality Inspection press; pp. 111-113; (English Translation included) Nov. 2013.
Henderson et al.; Estrogens as a cause of human cancer: The Richard and Hinda Rosenthal Foundation award lecture. Cancer Res, 48(2), pp. 246-253, Jan. 1988.
Hennequin et al.; Synthesizing microcapsules with controlled geometrical and mechanical properties with microfluidic double emulsion technology; Langmuir; 25(14); pp. 7857-7861; Jul. 2009.
Herdewijn et al.; 2'-5'-Gligoadenylates (2-5A) as Mediators of Interferon Action. Synthesis and Biological Activity of New 2-5A Analogues. E. De Clerq (ed ) Frontiers in Microbiology. 231-232. Springer, Dordrecht Jan. 1987.
Hertz et al.; Estrogen-progestogen combinations for contraception. Journal of the American Medical Association, 198(9), pp. 1000-1006, Nov. 1966.
Hong et al.; Three-dimensional digital microfluidic manipulation of droplets in oil medium; Scientific Reports; 5 (Article No. 10685); 5 pgs.; Jun. 2015.
Horn et al.; Oligonucleotides with alternating anionic and cationic phosphoramidate linkages: Synthesis and hybridization of stereo-uniform isomers; Tetrahedron Lett.; 37(6); pp. 743-746; Feb. 1996.
Hou et al.; Microfluidic devices for blood fractionation; Micromachines: 2(3); pp. 319-343; Jul. 20, 2011.
Huh et al.; Reversible Switching of High-Speed Air-Liquid Two-Phase Flows Using Electrowetting-Assisted Flow-Pattern Change, J. Am. Chem. Soc., 125, pp. 14678-14679; Dec. 2003.
Ihalainen et al; Application of paper-supported printed gold electrodes for impedimetric immunosensor development; Biosensors; 3(1); pp. 1-17; Mar. 2013.
Jacobson et al.; High-Speed Separations on a Microchip, Anal. Chem., 66(7), pp. 1114-1118, Apr. 1994.

(56) References Cited

OTHER PUBLICATIONS

Jacobson et al.; Precolumn Reactions with Electrophoretic Analysis Integrated on a Microchip, Anal. Chem., 66(23), pp. 4127-4132, Dec. 1994.
Jebrail et al., Combinatorial Synthesis of Peptidomimetics Using Digital Microfluidics, J. Flow Chem., 2(3), pp. 103-107; (online) Aug. 2012.
Jebrail et al., Lets get digital: digitizing chemical biology with microfluidics, Curr. Opin. Chem. Biol., 14(5), 574-581, Oct. 2010.
Jebrail et al., Synchronized synthesis of peptide-based macrocycles by digital microfiuidics, Angew. Chem. Int. Ed. Eng., 49(46), pp. 8625-8629, Nov. 2010.
Jebrail et al., World-to-digital-microfluidic interface enabling extraction and purification of RNA from human whole blood, Analytical Chemistry, 86(8), pp. 3856-3862, Apr. 2014.
Jebrail et al.; A Solvent Replenishment Solution for Managing Evaporation of Biochemical Reactions in Air-Matrix Digital Microfluidics Devices, Lab on a Chip, 15(1), pp. 151-158; Jan. 2015.
Jebrail et al.; Digital Microfluidic Method for Protein Extraction by Precipitation; Analytical Chemistry; 81(1); pp. 330-335; Jan. 2009.
Jebrail et al.; Digital Microfiuidics for Automated Proteomic Processing, Journal of Visualized Experiments, 33 (e1603), 5 pgs., Nov. 2009.
Jebrail et al.; Digital microfluidics: a versatile tool for applications in chemistry, biology and medicine; Lab Chip; 12 (14); pp. 2452-2463; Jul. 2012.
Jemere et al., An integrated solid-phase extraction system for sub-picomolar detection, Electrophoresis, 23(20), pp. 3537-3544, Oct. 2002.
Jenkins et al., The biosynthesis of carbocyclic nucleosides; Chem. Soc. Rev.; 24(3); pp. 169-176; Jan. 1995.
Jensen et al.; Free-running enzymatic oligonucleotide synthesis for data storage applications; bioRxiv; 1:355719; 7 pages; Jan. 2018.
Jessome et al.; Ion Suppression: A Major Concern in Mass Spectrometry. LC-GC North America, 24(5), pp. 498-510, May 2006.
Jia et al.; Ultrasensitive detection of microRNAs by exponential isothermal amplification; Angew. Chem. Int. Ed. Engl.; 49(32); pp. 5498-5501; Jul. 2010.
Jung et al.; Hybridization of Alternating Cationic/Anionic Oligonucleotides to RNA Segments; Nucleosides & Nucleotides; 13(6-7); pp. 1597-1605; Jul. 1994.
Kaaks et al.; Postmenopausal serum androgens, oestrogens and breast cancer risk: The European prospective investigation into cancer and nutrition. Endocrine-Related Cancer,12(4), pp. 1071-1082, Dec. 2005.
Keng et al., Micro-chemical synthesis of molecular probes on an electronic microfluidic device,PNAS, 109(3), pp. 690-695; Jan. 2012.
Kiedrowski et al., Parabolic Growth of a Self-Replicating Hexadeoxynucleotide Bearing a 3'-5'-Phosphoamidate Linkage; Angew. Chemie Intl. Ed.; 30(4); pp. 423-426; Apr. 1991.
Kim et al.; Automated digital microfluidic sample preparation for next-generation DNA sequencing; JALA; Journal of the Association for Laboratory Automation; 16(6); pp. 405-414; Dec. 2011.
Kim et al., A Microfluidic DNA Library Preparation Platform for Next-Generation Sequencing, PLoS ONE, 8(7), Article ID: e68988; 9 pgs., Jul. 2013.
Kim et al.; Microfabricated Monolithic Multinozzle Emitters for Nanoelectrospray Mass Spectrometry; Anal Chem; 79(10); pp. 3703-3707; May 2007.
Koster et al.; Drop-based microfluidic devices for encapsulation of single cells; Lab on a Chip; 8(7); pp. 1110-1115; Jul. 2008.
Kralj et al.; Integrated continuous microfluidic liquid-liquid extraction. Lab on a Chip, 7(2), pp. 256-263, Feb. 2007.
Kutter et al., Solid phase extraction on microfluidic devices, Journal of Microcolumn Separations, 12(2), pp. 93-97, Jan. 2000.
Kutter et al., Solvent- Programmed Microchip Open-Channel Electrochromatography, Analytical Chemistry, 70(15), pp. 3291-3297, Aug. 1998.
Labrie et al.; Androgen glucuronides, instead of testosterone, as the new markers of androgenic activity in women. The Journal of Steroid Biochemistry and Molecular Biology, 99(4-5), pp. 182-188, Jun. 2006.
Labrie; Intracrinology. Molecular and Cellular Endocrinology, 78(3), pp. C113-C118, Jul. 1991.
Lamar et al.; Serum sex hormones and breast cancer risk factors in postmenopausal women. Cancer Epidemiol Biomarkers Prev, 12(4), pp. 380-383, Apr. 2003.
Langevin et al., A rapid and unbiased method to produce strand-specific RNA-Seq libraries from small quantities of starting materiaRNA Biol., 10(4), pp. 502-515, (online) Apr. 2013.
Lawyer et al.; High-level expression, purification, and enzymatic characterization of full-length Thermus aquaticus DNA polymerase and a truncated form deficient in 5' to 3' exonuclease activity; Genome Res; 2(4); pp. 275-287; May 1993.
Lawyer et al.; Isolation, characterization, and expression in *Escherichia coli* of the DNA polymerase gene from Thermus aquaticus; J. Biol. Chem.; 264; pp. 6427-6437; Apr. 1989.
Lebrasseur et al.; Two-dimensional electrostatic actuation of droplets using a single electrode panel and development of disposable plastic film card; Sensors and Actuators A; 136(1); pp. 368-386; May 2007.
Lee et al.; Electrowetting and electrowetting-on-dieiectric for microscale liquid handling, Sens. Actuators A, 95(2), pp. 259-268, Jan. 2002.
Lee et al.; Removal of bovine serum albumin using soiid-phase extraction with in-situ polymerized stationary phase in a microfluidic device: Journal of Chromatography A; 1187(1-2): pp. 11-17; Apr. 2008.
Lee et al.; Surface-Tension-Driven Microactuation Based on Continuous Electrowetting; J. Microelectromechanical Systems; 9(2); pp. 171-180; Jun. 2000.
Leriche et al.; Cleavable linkers in chemical biology; Bioorganic & Medicinal Chemistry; 20(2); pp. 571-582; Jan. 15, 2012.
Letsinger et al., Cationic oligonucleotides, J. Am. Chem. Soc., 110(13), pp. 4470-4471, Jun. 1988.
Letsinger et al., Effects of pendant groups at phosphorus on binding properties of d-ApA analogues, Nucl. Acids Res., 14(8), pp. 3487-3499, Apr. 1986.
Letsinger et al., Phosphoramidate analogs of oligonucleotides, J. Org. Chem., 35(11), pp. 3800-3803, Nov. 1970.
Lettieri et al., A novel microfluidic concept for bioanalysis using freely moving beads trapped in recirculating flows, Lab on a Chip, 3(1), pp. 34-39, Feb. 2003.
Levy et al.; Genetic screening of newborns, Annual Review of Genomics and Human Genetics, 1, pp. 139-177, Sep. 2000.
Li et al., A perspective on paper-based microfiuidics: Current status and future trends, Biomicrofluidics, 6(1), pp. 011301 (13 pgs), Mar. 2012.
Li et al., Application of microfluidic devices to proteomics research: identification of trace-level protein digests and affinity capture of target peptides. Molecular & cellular Proteomics, 16(2), pp. 157-168, Feb. 2002.
Li et al., Paper-based microfluidic devices by plasma treatment. Anal. Chem., 80(23), pp. 9131-9134, Nov. 2008.
Li et al.; A Low-Cost and High resolution droplet position detector for art intelligent electrowetting on dielectric device; Journal of Lab. Automation 2015; 20(6); pp. 663-669; Dec. 2015.
Li et al.; One-step ultrasensitive detection of microRNAs with loop-mediated isothermal amplification (LAMP); Chem Commun; 47(9); pp. 2595-2597; Mar. 2011.
Li et al.; Test structure for characterizing low voltage coplanar EWOD system: IEEE Transaction on Semiconductor Manufacturing; IEEE Service Center; Piscataway, NJ.; 22(1); pp. 88-95; Feb. 4, 2009.
Liana et al.; Recent Advances in Paper-Based Sensors; Sensors; 12(9); pp. 11505-11526; Aug. 2012.
Link et al.; Electric Control of Droplets in Microfluidic Devices; Angew Chem Int Ed Engl; 45(16); pp. 2556-2560; Apr. 2006.
Liu et al., Three-dimensional paper microfluidic devices assembled using the principles of origami, JACS, 133(44), pp. 17564-17566, Nov. 2011.

(56) References Cited

OTHER PUBLICATIONS

Liu et al.; Attomolar ultrasensitive microRNA detection by DNA-scaffolded silver-nanocluster probe based on isothermal amplification; Anal Chem; 84(12); pp. 5185-5169; Jun. 2012.
Lizardi et al.; Mutation detection and single-molecule counting using isothermal rolling-circle amplification; Nat. Genet.; 19(3); pp. 225-232; Jul. 1998.
Locascio et al.; Surface chemistry in polymer microfluidic systems; in Lab-on-a-Chip; Elsevier Science; 1st Ed.; pp. 65-82; Oct. 2003.
Loeber; Neonatal screening in Europe; the situation in 2004, Journal of Inherited Metabolic Disease, 30(4), pp. 430-438, Aug. 2007.
Lohman et al.; Efficient DNA ligation in DNA-RNA hybrid helices by Chlorella virus DNA ligase; Nucleic Acids Research; 42(3); pp. 1831-1844; Nov. 2013.
Luk et al.; Pluronic Additives: A Solution to Sticky Problems in Digital Microfiuidics, Langmuir, 24(12), pp. 6382-6389, Jun. 2008.
Luk et al.; A digital microfluidic approach to proteomic sample processing; Analytical Chemistry; 81(11); pp. 4524-4530; Jun. 2009.
Mag et al., Synthesis and selective cleavage of an oligodeoxynucleotide containing a bridged internucleotide 5'-phosphorothioate linkage, Nucleic Acids Res., 19(7), pp. 1437-1441, Apr. 1991.
Mais et al.; A solvent replenishment solution for managing evaporation of biochemical reactions in air-matrix digital microfluidics devices; Lab on a Chip; 15(1); pp. 151-158; Jan. 2015.
Makamba et al.; Surface modification of poly(dimethylsiloxane) microchannels; Electrophoresis; 24(21); pp. 3607-3619; Nov. 2003.
Malloggi et al.; Electrowetting—A versatile tool for controlling microdrop generation, Eur. Phys. J. E, 26(1), pp. 91-96, May 2008.
Mandl et al.; Newborn screening program practices in the United States: notification, research, and consent, Pediatrics, 109(2), pp. 269-273, Feb. 2002.
Maroney et al.; A Rapid, quantitative assay for direct detection of microRNAs and other small RNAs using splinted ligation; RNA; 13(6); pp. 930R936; Jun. 2007.
Maroney et al.; Direct detection of small RNAs using splinted ligation; Nat. Protocols3(2); pp. 279-287; Jan. 2008.
Marre et al.; Synthesis of micro and nanostructures in microfluidic systems; Chemical Society Reviews; 39(3); pp. 1183-1202; Mar. 2010.
Martinez et al., Simple Telemedicine for Developing Regions: Camera Phones and Paper-Based Microfluidic Devices for Reai-Time, Off-Site Diagnosis, Anal. Chem., 80(10), pp. 3699-3707, May 2008.
Martinez et al., Three-dimensional microfluidic devices fabricated in layered paper and tape, PNAS, 105(50), pp. 19606-19611, Dec. 2008.
Martinez et al.; Patterned paper as a platform for inexpensive low-volume, portable bioassays, Angewandte Chemie, 46(8), pp. 1318-1320, Feb. 2007.
Martinez-Sanchez et al.; MicroRNA Target Identification—Experimental Approaches; Biology; 2; pp. 189-205; Jan. 2013.
Matern et al.; Reduction ofthe false-positive rate in newborn screening by implementation of MS/MS-based second-tier tests: the Mayo Clinic experience (2004-2007), Journal of Inherited Metabolic Disease, 30(4), pp. 585-592, Aug. 2007.
Mauney, Thermal Considerations for Surface Mount Layouts, in Texas Instruments Portable Power Supply Design Seminar, 16 pgs., 2006.
Mega; Heterogenous ion-exchange membranes RALEX; 3 pgs.; retrieved Mar. 1, 2016 from the internet: http://www.mega.cz/heterogenous-ion-exchange-membranes-ralex.html.
Meier et al., The photochemistry of stilbenoid compounds and their role in materials technology, Chem. Int. Ed. Engl., 31(11), pp. 1399-1420, Nov. 1992.
Mellors et al.; Fully Integrated Glass Microfluidic Device for Performing High-Efficiency Capillary Electrophoresis and Electrospray Ionization Mass Spectrometry, Analytical Chemistry, 80(18), pp. 6881-6887 (Author Manuscript, 18 pgs.). Sep. 2008.
Michigan Dept. of Community Health; Specimen collection procedure from Michigan Newborn Screening Program, 37 pgs., (retrieved Feb. 9, 2017 online: http://web.archive.org/web/20100715000000*/http://www.michigan.gov/documents/Bloodco2_60773_7. pdf) Jul. 2009.
Miller et al.; A digital microfluidic approach to homogeneous enzyme assays, Anal. Chem., 80(5), pp. 1614-1619, Mar. 2008.
Millington et al.; Digital Microfluidics: A Future Technology in the Newborn Screening Laboratory?, Seminars in Perinatology, 34(2), pp. 163-169 (Author Manuscript, 14 pgs.), Apr. 2010.
Millington et al.; Digital Microfluidics: A novel platform for multiplexed detection of LSDs with potential for newborn screening (conference presentation); Oak Ridge Conference; 15 pgs.; 2009.
Millington et al.; Tandem mass spectrometry: a new method for acylcamitine profiling with potential for neonatal screening for inborn errors of metabolism, Journal of Inherited Metabolic Disease, 13(3), pp. 321y324, May 1990.
Millington et al.; The Analysis of Diagnostic Markers of Genetic Disorders in Human Blood and Urine Using Tandem Mass Spectrometry With Liquid Secondary Ion Mass Spectrometry, International Journal of Mass Spectrometry, 111, pp. 211-228, Dec. 1991.
Miralles et al.; A Review of Heating and Temperature Control in Microfluidic Systems: Techniques and Applications; Diagnostics; 3; pp. 33-67; Jan. 2013.
Mitchell et al.; Circulating microRNAs as stable blood-based markers for cancer detection; Proc Nat Acad Sci; 105(30); pp. 10513-10518; Jul. 2008.
Moon et al.; An integrated digital microfluidic chip for multiplexed proteomic sample preparation and analysis by MALDI-MS. Lab Chip, 6(9), pp. 1213-1219, Sep. 2006.
Moqadam et al.; The Hunting of Targets: Challenge in miRNA Research; Leukemia; 27(1); pp. 16-23; Jan. 2013.
Mousa et al.; Droplet-scale estrogen assays in breast tissue, blood, and serum, Science Translational Medicine, 1(1), 6 pgs., Oct. 2009.
Murran et al.; Capacitance-based droplet position estimator for digital microfluidic devices; Lab Chip;12(11); pp. 2053-2059; May 2012.
Nakamura et al.; Simple and accurate determination of CYP2D6 gene copy number by a loop-mediated isothermal amplification method and an electrochemical DNA chip; Clinica Chimica Acta; 411(7-8); pp. 568-573; Apr. 2010.
Nelson et al., Incubated protein reduction and digestion on an EWOD digital microfluidic chip for MALDI-MS, Analytical Chemistry, 82(23), pp. 9932-9937, Dec. 2010.
Newborn Screening Ontario, The newborn screening ontario unsatisfactory sample indicator (educational resource), 3 pgs., retrieved online: https://www.newbornscreening.on.ca/en/health-care-providers/submitters/report-cards/nso_unsatisfatory_sample_indicator_ian_2017, (web address was available to applicant(s) at least as of Jan. 2010).
Ng et al., Digital microfluidic magnetic separation for particle-based immunoassays, Anal. Chem., 84(20), 8805-8812, Oct. 2012.
Nilsson et al.; RNA-templated DNA ligation for transcript analysis; Nucl. Acid Res.; 29(2); pp. 578-581; Jan. 2001.
Njiru; Loop-Mediated Isothermal Amplification Technology: Towards Point of Care Diagnostics; PLoS; 6(6); pp. e1572 (4 pgs.); Jun. 2012.
Notomi et al.; Loop-mediated isothermal amplification of DNA; Nucleic Acid Research; 28(12); p. e63 (7 pgs.); Jun. 2000.
Okubo et al.; Liquid-liquid extraction for efficient synthesis and separation by utilizing micro spaces. Chemical Engineering Science, 63(16), pp. 4070-4077, Aug. 2008.
Oleschuk et al., Trapping of bead-based reagents within microfluidic systems: On-chip solid-phase extraction and electrochromatography, Analytical Chemistry, 72(3), pp. 585-590, Feb. 2000.
Padilla et al.; Newborn screening in the Asia Pacific region, Journal of Inherited Metabolic Disease, 30(4), pp. 490-506, Aug. 2007.
Palluk et al.; De novo DNA synthesis using polymerase-nucleotide conjugates; Nature biotechnology; 36(7); pp. 645-650; Jun. 18, 2018.
Paik et al., Coplanar digital microfluidics using standard printed circuit board processes, in Proceedings 9th Int'l Conf Miniaturized

(56) References Cited

OTHER PUBLICATIONS

Systems for Chemistry and Life Sciences (MicroTAS 2005), Boston, MA, USA, pp. 566-568, Oct. 9-13, 2005.
Paneri et al.; Effect of change in ratio of electrode to total pitch length in EWOD based microfluidic system; InComputer Applications and Industrial Electronics (ICCAIE); 2010 International Conference; pp. 25-28; Dec. 5, 2010.
Parida et al.; Rapid detection and differentiation of Dengue virus serotypes by a real-time reverse transcription-loop-mediated isothermal amplification assay; J Clinical Microbiology; 43(6); pp. 2895-2903; Jun. 2005.
Pauwels et al., Biological-Activity of New 2-5a Analogs, Chemica Scripta, 26(1), pp. 141-145, Mar. 1986.
Peltonen et al.; Printed electrodes on tailored paper enable electrochemical functionalization of paper; TAPPI Nanotechnology Conference; Espoo, Finland; 20 pgs.; Sep. 2010.
Peterschmitt et al.; Reduction of false negative results in screening of newborns for homocystinuria, New England Journal of Medicine, 341(21), 1572-1576, Nov. 1999.
Petersen et al., On-chip electro membrane extraction, Microfluidics and Nanofluidics, 9(4), pp. 881-888, Oct. 2010.
Pitt et al.; Hormone replacement therapy for osteoporosis. Lancet, 335 (8695), p. 978, Apr. 1990.
Pollack et al.; Electrowetting-based actuation of droplets for integrated microfluidics; Lab on a Chip; 2(2); pp. 96-101; May 2002.
Pollack et al.; Electrowetting-based actuation of liquid droplets for microfluidic applications, Appl. Phys. Lett., 77(11), pp. 1725-1726, Sep. 2000.
Provincial Health Services Authority (British Columbia Perinatal Health Program), Perinatal Services BC Neonatal Guideline 9: Newborn Screening, 29 pgs., (retrieved Feb. 9, 2017 online: http://www.perinatalservicesbc.ca/health-professionals/guidelines-standards/newborn) guideline revised: Dec. 2010.
Rahhal et al.; The impact of assay sensitivity in the assessment of diseases and disorders in children. Steroids, 73(13), pp. 1322-1327, Dec. 2008.
Rashad; Clinical applications of tandem mass spectrometry: ten years of diagnosis and screening for inherited metabolic diseases, Journal of Chromatography B: Biomedical Sciences and Applications, 7 58(1), pp. 27-48, Jul. 2001.
Rashed et al.; Diagnosis of inborn errors of metabolism from blood spots by acylcamitines and amino acids profiling using automated electrospray tandem mass spectrometry, Pediatric Research, 38(3), 324-331, Sep. 1995.
Rawls, Optimistic About Antisense: Promising clinical results and chemical strategies for further improvements delight antisense drug researchers; Chemical & Engineering News; 75(22); pp. 35-39; Jun. 2, 1997.
Ren et al., Automated on-chip droplet dispensing with volume control by electro-wetting actuation and capacitance metering, Sens. Actuator B Chem., 98(2-3), pp. 319-327, Mar. 2004.
Ren et al.; Design and testing of an interpolating mixing architecture for electrowetting-based droplet-on-chip chemical dilution; 12th International Conference on TRANSDUCERS, Solid-State Sensors, Actuators and Microsystems; vol. 2; Boston, MA, USA; pp. 619-622; Jun. 8-12, 2003.
Ro et al.; Poly (dimethylsiloxane) microchip for precolumn reaction and micellar electrokinetic chromatography of biogenic amines, Electrophoresis, 23(7-8), pp. 1129-1137, Apr. 2002.
Roman et al.; Fully integrated microfluidic separations systems for biochemical analysis, J. Chromatogr. A, 1168(1-2), pp. 170-188, Oct. 2007.
Roman et al.; Sampling and Electrophoretic Analysis of Segmented Flow Streams in a Microfluidic Device, Anal. Chem., 80(21), pp. 8231-8238 (author manuscript, 19 pgs.), Nov. 2008.
Sabourin et al.; Interconnection blocks: a method for providing reusable, rapid, multiple, aligned and planar microfluidic interconnections; Journal of Micromechanics and Microengineering; 19(3); 10 pages; doi:10.1088/0960-1317/19/3/035021; Feb. 18, 2009.
Sadeghi et al.; On Chip Droplet Characterization: A Practical, High-Sensitivity Measurement of Droplet Impedance in Digital Microfluidics; Anal. Chem.; 84(4); pp. 1915-1923; Feb. 2012.
Sahai et al.; Newborn screening, Critical Reviews in Clinical Laboratory Sciences, 46(2), pp. 55-82, (online) Mar. 2009.
Samsi et al.; A Digital Microfluidic Electrochemical Immunoassay; Lab on a Chip; 14(3); pp. 547-554; Feb. 2014.
Sanghvi & Cook (Ed.); Carbohydrate Modifications in Antisense Research; Chapters 2 and 3, American Chemical Society, Washington DC; (207th National Meeting of the American Chemical Society Mar. 13-17, 1994, San Jose, CA); Dec. 1994.
Sanghvi & Cook (Ed.); Carbohydrate Modifications in Antisense Research; Chapters 6 and 7, American Chemical Society, Washington DC; (207th National Meeting of the American Chemical Society Mar. 13-17. 1994, San Jose, CA); Dec. 1994.
Santen et al.; Superiority of gas chromatography/tandem mass spectrometry assay (GC/MS/MS) for estradiol for monitoring of aromatase inhibitor therapy. Steroids, 72(8), pp. 666-671, Jul. 2007.
Sasano et al.; From Endocrinology to Intracrinology. Endocr Pathol, 9(1), pp. 9-20, Spring 1998.
Satoh et al.; Electrowetting-based valve for the control of the capillary flow, J. Appl. Phys., 103(3), 034903, Feb. 2008.
Satoh et al.; On-chip microfluidic transport and mixing using electrowetting and incorporation of sensing functions, Anal. Chem., 77(21), pp. 6857-6863, Nov. 2005.
Sawai et al., Synthesis and properties of oligoadenylic acids containing 2?-5? phosphoramide linkage, Chem. Lett., 13(5), pp. 805-808, May 1984.
Schertzer et al.; Using capacitance measurements in EWOD devices to identify fluid composition and control droplet mixing; Sens. Actuators B; 145(1); pp. 340-347; Mar. 2010.
Scriver_Commentary, A Simple Phenylalanine Method for Detecting Phenylketonuria in Large Populations of Newborn Infants by Guthrie et al., Pediatrics, 32(3), 338-343, Sep. 1963.
Shah et al., On-demand droplet loading for automated organic chemistry on digital microfluidics, Lab Chip, 13(14), pp. 2785-2795, Jul. 2013.
Shamsi et al; A digital microfluidic electrochemical immunoassay; Lab on a Chip; 14(3); pp. 547-554; (the year of publication is sufficiently earlier than the effective U.S. filing date and any foreign priority date so that the particular month of publication is not in issue) 2014.
Shih et al., A feedback control system for high-fidelity digital microfluidics, Lab Chip, 11(3), pp. 535-540, Feb. 2011.
Simpson et al.; Estrogen—the Good, the Bad, and the Unexpected. Endocr Rev, 26(3), pp. 322-330; May 2005.
Sinha et al., A Versatile Automated Platform for Micro-scale Cell Stimulation Experiments, J. Vis. Exp., e50597, 8 pgs., Aug. 2013.
Sinton et al.; Electroosmotic velocity profiles in microchannels, Colloids Surf. A, 222(1-3), pp. 273-283, Jul. 2003.
Skendzel, Rubella immunity: Defining the level of protective antibody, Am. J. Clin. Pathol., 106(2), 170-174, Aug. 1996.
Smith et al; Diagnosis and Management of Female Infertility. Journal of the American Medical Association 290(13), pp. 1767-1770, Oct. 2003.
Sooknanan et al., Nucleic Acid Sequence-Based Amplification, Ch. 12; Molecular Methods for Virus Detection (1st Ed.), Academic Press, Inc., pp. 261-285; Jan. 1995.
Sprinzl et al., Enzymatic incorporation of ATP and CTP analogues into the 3' end of tRNA, Eur. J. Biochem., 81(3), pp. 579-589, Dec. 1977.
Srinivasan et al.; An integrated digital microfluidic lab-on-a-chip for clinical diagnostics on human physiological fluids, Lab Chip, 4(4), pp. 310-315, Aug. 2004.
Stanczyk et al.; Standardization of Steroid Hormone Assays Why, How, and When?, Cancer Epidemiol Biomarkers Prev, 16(9), pp. 1713-1719, Sep. 2007.
Steckl et al.; Flexible Electrowetting and Electrowetting on Flexible Substrates; Proc. SPIE 7956; Advances in Display Technologies; and E-papers and Flexible Displays; 795607 (6 pgs.); Feb. 2011.
Stegink et al.; Plasma amino acid concentrations and amino acid ratios in normal adults and adults heterozygous for phenylketonuria

(56) References Cited

OTHER PUBLICATIONS ingesting a hamburger and milk shake meal, American Journal of Clinical Nutrition, 53(3), pp. 670-675, Mar. 1991.
Sun et al.; Rapid and direct microRNA quantification by an enzymatic luminescence assay; (author manuscript; 17 pgs.) Analytical Biochemistry; 429(1); pp. 11-17; Oct. 2012.
Svoboda et al.; Cation exchange membrane integrated into a microfluidic device; Microelectronic Engineering; 86; pp. 1371-1374; Apr-Jun. 2009.
Szarewski et al.; Contraception. Current state of the art. British Medical Journal, 302(6787), pp. 1224-1226, May 1991.
Szymczak et al.; Concentration of Sex Steroids in Adipose Tissue after Menopause. Steroids, 63(5-6), pp. 319-321, May/Jun. 1998.
Tachibana et al.; Application of an enzyme chip to the microquantification of L-phenylalanine, Analytical Biochemistry, 359(1), pp. 72-78, Dec. 2006.
Tan et al.; A lab-on-a-chip for detection of nerve agent sarin in blood; Lab Chip; 8(6); pp. 885-891; Jun. 2008.
Tang et al.; Mechano-regulated surface for manipulating liquid droplets; Nature Communications; 10 pages; DOI: 10.1038/ncomms14831; ; April 4, 2017.
Teh et al.; Droplet microfluidics, Lab Chip, 8(2), pp. 198-220, Feb. 2008.
Theberge et al.; Microdroplets in microfluidics: an evolving plarform for discoveries in chemistry and biology; Angewandte Chemie International Edition; 49(34); pp. 5846-5868; Aug. 2010.
Therrell et al.; Newborn screening in North America, Journal of Inherited Metabolic Disease, 30(4), pp. 447-465, Aug. 2007.
Tian et al., Printed two-dimensional micro-zone plates for chemical analysis and ELISA, Lab on a Chip, 11(17), pp. 2869-2875, Sep. 2011.
Tobjörk et al., IR-sintering of ink-jet printed metal-nanoparticles on paper, Thin Solid Films, 520(7), pp. 2949-2955, Jan. 2012.
Tomita et al.; Loop-mediated isothermal amplification (LAMP) of gene sequences and simple visual detection of products; Nature Protocols; 3(5); pp. 877-882; (online) Apr. 2008.
Torkkeli; Droplet microfluidics on a planar surface; VTT Technical Research Centre of Finland; Publications 504; 214 pages (Dissertation); Oct. 2003.
Turgeon et al.; Combined Newborn Screening for Succinylacetone, Amino Acids, and Acylcarnitines in Dried Blood Spots, Clinical Chemistry, 54(4), pp. 657-664, Apr. 2008.
Udenfriend et al.; Fluorescamine: a reagent for assay of amino acids, peptides, proteins, and primary amines in the picomole range, Science, 178(4063), pp. 871-872, Nov. 1972.
Unger et al.; Monolithic microfabricated valves and pumps by multilayer soft lithography, Science, 288(5463), pp. 113-116, Apr. 2000.
Univ. of Maryland—Baltimore Washington Medical Center; Plasma amino acids, 6 pgs., retrieved Feb. 10, 2017 from: http://www.mybwmc.org/library/1/003361, Web address available to applicant(s) at least as of Jan. 2010.
Verkman; Drug Discovery in Academia: Am J Physiol Cell Physiol: 286(3): pp. C465-C474; Feb. 2004.
Walker et al.; A Chemiluminescent DNA Probe Test Based on Strand Displacement Amplification (Chapter 15); Molecular Methods for Virus Detection (1st Ed.), Academic Press, Inc., pp. 329-349; Jan. 1995.
Walker et al.; A passive pumping method for microfluidic devices, Lab Chip, 2(3), pp. 131-134, Aug. 2002.
Wang et al., Paper-based chemiluminescence ELISA: lab-on-paper based on chitosan modified paper device and, Biosens. Bioelectron., 31(1), pp. 212-218, Jan. 2012.
Wang et al., Simple and covalent fabrication of a paper device and its application in sensitive chemiluminescence immunoassay, Analyst, 137(16), pp. 3821-3827, Aug. 2012.
Wang et al.; An integrated microfluidic device far large-scale in situ click chemistry screening; Lab on a Chip; 9(16); 9(16); pp. 2281-2285; 9 pages (Author Manuscript); Aug. 2009.
Wang et al.; Highly sensitive detection of microRNAs based on isothermal exponential amplification-assisted generation of catalytic G-quadruplexDNAzyme; Biosensors and Bioelectronics, 42; pp. 131-135; Apr. 2013.
Washburn et al.; Large-scale analysis of the yeast proteome by multidimensional protein identification technology, Nat. Biotechnol., 19(3), pp. 242-247, Mar. 2001.
Watson et al.; Multilayer hybrid microfluidics: a digital-to-channel interface for sample processing and separations; Anal. Chem.; 82(15); pp. 6680-6686; Aug. 2010.
Wheeler et al.; Electrowetting-Based Microfluidics for Analysis of Peptides and Proteins by Matrix-Assisted Laser Desorption/Ionization Mass Spectrometry; Anal Chem; 76(16); pp. 4833-4838; Aug. 2004.
Wheeler; Chemistry. Putting electrowetting to work; Science; 322(5901); pp. 539-540; Oct. 2008.
Wlodkowic et al.; Tumors on chips: oncology meets microfluidics; Current opinion in Chemical Biology; 14(5); pp. 556-567; Oct. 2010.
Wu et al.; Design, Simulation and Fabrication of Electrowetting-Based Actuators for Integrated Digital Microfluidics; Proceedings of the 1st IEEE International Conference on Nano/Micro Engineered and Molecular Systems; Zhuhai, China; pp. 1097-1100; Jan. 18-21, 2006.
Wu et al.; Electrophoretic separations on microfluidic chips, J. Chromatogr. A, 1184(1-2), pp. 542-559, Mar. 2008.
Yan et al., A microfluidic origami electrochemiluminescence aptamer-device based on a porous Au-paper electrode and a phenyleneethynylene derivative, Chem. Commun. (Camb), 49(14), pp. 1383-1385, Feb. 2013.
Yan et al., Paper-based electrochemiluminescent 3D immunodevice for lab-on-paper, specific, and sensitive point-of-care testing, Chem.—Eur. J., 18(16), pp. 4938-4945, Apr. 2012.
Yi et al,; Spangler et al., Eds; Channel-to-droplet extractions for on-chip sample preparation, in Proceedings of Soiid-State Sensor, Actuator and Microsystems Workshop, pp. 128-131, Jun. 2006.
Yin et al.; One-step, multiplexed fluorescence detection of microRNAs based on duplex-specific nuclease signal amplification; J. American Chem. Soc.; 134(11); pp. 5064-5067; Mar. 2012.
Yoon et al.; Preventing Biomolecular Adsorption in Electrowetting-Based Biofluidic Chips; Anal Chem; 75; pp. 5097-5102; Aug. 2003.
Yoon; Open-Surface Digital Microfluidics; The Open Biotechnology Journal; 2(1); pp. 94-100; Apr. 2008.
Young et al.; Calculation of DEP and EWOD Forces for Application in Digital Microfluidics, J. Fluids Eng., 130(8), pp. 081603-1-081603-9, Jul. 2008.
Yu et al., Monolithic porous polymer for on-chip solid-phase extraction and preconcentration prepared by photoinitiated in situ polymerization within a microfluidic device, Analytical Chemistry , 73(21), pp. 5088-5096, Nov. 2001.
Yu et al., Preparation of monolithic polymers with controlled porous properties for microfluidic chip applications using photoinitiated free-radical polymerization, Journal of Polymer Science, Part A: Polymer Chemistry, 40(6), pp. 755-769, Mar. 2002.
Yu et al.; A plate reader-compatible microchannel array for cell biology assays; Lab Chip; 7(3); pp. 388-391; Mar. 2007.
Yu et al.; Microfabrication of a digital microfluidic platform integrated with an on-chip electrochemical cell; Journal of Micromechanics and Micromgineenng; 23(9); pp. 10 pages; doi: 10.1088/0960-1317/23/9/095025; Aug. 2013.
Yu et al.; Microfabtrication of a digital microfluidic platform integrated with an on-chip electrochemical cell; Journal of Micromechanics and Microengineering; 23(9); doi:10.1088/0960-1317/23/9/095025, 10 pages; Aug. 28, 2013.
Yu et al.; Parallel-plate lab-on-chip electrochemical analysis; Journal of Micromechanics and Microengineering; 24(1); 7 pages; doi: 10.1088/0960-1317/24/1/015020; Dec. 16, 2013.
Yue; Undergraduate Chemistry experiment (11); Hunan Normal University Press; First Edition; p. 96; (Machine Translation included); Oct. 2008.
Yung et al.; Micromagnetic-microfluidic blood cleansing devices; Lab on a Chip; 9(9); pp. 1171-1177; May 2009.

(56) References Cited

OTHER PUBLICATIONS

Zaffanello et al.; Multiple positive results during a neonatal screening program: a retrospective analysis of incidence, clinical implications and outcomes, Journal of Perinatal Medicine, 33(3), pp. 246-251, May 2005.
Zhang et al.; Multiplexed detection of microRNAs by tuning DNA-scaffolded silver nanoclusters; Analyst; 138(17); pp. 4812-4817; Sep. 2013.
Zhang et al.; The permeability characteristics of silicone rubber; In Proceedings of 2006 SAMPE Fall Technical Conference; 10 pages; Nov. 6, 2006.
Zhao et al., Lab on Paper, Lab Chip, 8(12), pp. 1988-1991, Dec. 2008.
Znidarsic-Plazl et al.; Steroid extraction in a microchannel system-mathematical modelling and experiments. Lab Chip, 7(7), pp. 883-889, Jul. 2007.
Zuker; Mfold Web Server for Nucleic Acid Folding and Hybridization Prediction; Nucleic Acid Research ; 31(13); pp. 3406-3415; Jul. 2003.
Zytkovicz et al.; Tandem mass spedrometric analysis for amino, organic, and fatty acid disorders in newborn dried blood spots: a two-year summary from the New England Newborn Screening Program, Clinical Chemistry, 47(11), pp. 1945-1955, Nov. 2001.
Cervantes et al.; U.S. Appl. No. 17/427,290 entitled "Nonfouling compositions and methods for manipulating and processing encapsulated droplets," filed Jul. 30, 2021.
Soto-Moreno et al.; U.S. Appl. No. 17/434,531 entitled "Digital microfluidics devices and methods of using them," filed Aug. 27, 2021.
Jebrail et al.; U.S. Appl. No. 17/561,166 entitled "Digital microfluidic devices and methods," filed Dec. 23, 2021.

* cited by examiner

DIGITAL MICROFLUIDICS DEVICES AND METHODS OF USE THEREOF

CROSS REFERENCE TO RELATED APPLICATIONS

This patent application claims priority to U.S. provisional patent application No. 62/878,689, titled "OPTICAL HEATING AND CONTROL FOR DIGITAL MICROFLUIDICS," and filed on Jul. 25, 2019, herein incorporated by reference in its entirety.

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

Digital microfluidic (DMF) apparatuses and methods for optically-induced heating and manipulating droplets are described herein.

BACKGROUND

Microfluidics has transformed the way traditional procedures in molecular biology, medical diagnostics, and drug discovery are performed. Lab-on-a-chip and biochip type devices have drawn much interest in both scientific research applications as well as potentially for point-of-care applications because they carry out highly repetitive reaction steps within a small reaction volume, saving both materials and time. Traditional biochip-type devices utilize micro- or nano-sized channels and typically require corresponding micropumps, microvalves, and microchannels coupled to the biochip to manipulate the reaction steps. As a result, these additional components greatly increase cost and complexity of biochip-type microfluidic devices.

Digital microfluidics (DMF) has emerged as a powerful preparative technique for a broad range of biological and chemical applications. DMF enables real-time, precise, and highly flexible control over multiple samples and reagents, including solids, liquids, and even harsh chemicals, without need for pumps, valves, or complex arrays of tubing. In DMF, discrete droplets of nanoliter to microliter volumes are dispensed from onto a planar surface where they are manipulated (transported, split, merged, mixed, heated, cooled) by applying a series of electrical potentials to an embedded array of electrodes. Straightforward control over multiple reagents, without requiring pumps, valves or tubing, is provided. Facile handling or both solids and liquids is possible, and is not subject to channel clogging. Even troublesome reagents such as organic solvents or corrosive chemicals may be handled upon the droplet handling surface as DMF systems generally have a hydrophobic surface which is substantially chemically inert (such as, but not limited to Polytetrafluoroethylene (PTFE)-coated surfaces). Complex reaction steps can be carried out using DMF alone, or using hybrid systems in which DMF is integrated with channel-based microfluidics.

Despite significant advances, currently available architectures for a DMF apparatus (e.g., system, device, etc.) typically employ thermoelectric cooling (TEC) heater devices at fixed positions underlying a droplet actuation surface of a DMF apparatus (e.g., affixed to the lower surface of a PCB substrate having actuation electrodes adjacent to the upper surface thereof). This can be limiting when designing DMF apparatuses to support complex multistep protocols or multiplex operations.

There is a need to develop more flexible DMF apparatuses affording "on demand" heating across the droplet manipulation surface of the DMF apparatus to enable these more demanding workflows.

SUMMARY OF THE DISCLOSURE

The present invention relates to digital microfluidics (DMF) apparatuses (e.g., systems, devices, etc.) that utilize photonic heating (i.e., light absorption by certain materials, converting the energy from illumination into thermal energy) to heat droplets disposed on or adjacent to a droplet manipulation surface of a support (e.g., an upper surface of a PCB) of the DMF apparatus. Generally, the apparatuses described herein direct illumination at the opposite side of the support (e.g., the lower surface of the support), away from the droplet manipulation surface, heating the region of illumination of the lower surface of the support and transferring thermal energy to the upper surface of the support without directly illuminating the droplet, which may prevent photonic damage to the material being transported by the droplet. The transferred thermal energy heats a region about the upper surface of the support (in some variations the associated drive electrode), resulting in heating the droplet. Illumination of the droplet itself is avoided, thereby preventing exposure and possible degradation of reagents or samples contained within the droplet.

The amount of thermal energy produced at the lower surface of the support may be detectable as a characteristic black-body radiation of the material disposed at the illuminated location, and the detected temperature can be used within a closed loop feedback system to modulate the heating of the droplet. Alternatively or additionally, the temperature may be detected by one or more thermistors or other temperature sensors in/on the first support, (e.g., electrowetting drive electrodes, light absorbing regions, thermally conductive vias, etc.). The selective and independent illumination of one or more locations of the lower surface of the support permits multiplexed heating at highly flexible positions upon the droplet manipulation surface of the support.

Any of the apparatuses described herein may also provide cooling, an in particular cooling from within the region between the upper (first) support and the lower (second) support. For example, cooling of the droplet manipulation surface can also be achieved, permitting complex heating/cooling operations at a myriad of positions upon the droplet manipulation surface of the DMF apparatus.

A significant advantage of a DMF apparatus employing photonic heating as described herein is the radical simplification of routing droplets/reagents in complex, multistep protocols and/or highly plexed workflows. The workflow controller has much greater freedom in pathfinder algorithm operations to focus solely on reagent/droplet cross-contamination rules without having to consider such hardware limitations as fixed positions of hardware-driven heating components such as TEC heaters attached to the lower surface of the droplet manipulation support. A DMF apparatus employing an architecture coupling two supports, e.g., PCBs, which are connected or coupled together to provide droplet manipulation and droplet heating/cooling as described herein can also provide reduced cost by removing typically used TEC heating/cooling devices. A DMF apparatus so configured may also provide greatly improved power efficiency compared to a DMF apparatus incorporating a plurality of TEC heating/cooling devices to provide similar numbers of heating/cooling regions.

For example, described herein are digital microfluidic (DMF) apparatus that may include: a seating region configured to seat a DMF cartridge thereon; a plurality of electrowetting drive electrodes in electrical communication with the seating region; a plurality light-absorbing regions thermally coupled to a plurality of regions of the seating region; a plurality of light emitters separated from the seating region by a first air gap, wherein each light emitter is configured to emit light into the air gap to heat one or more of the light-absorbing regions; and a controller configured to control the light emitted by each of the light emitters to regulate a temperature of each of a plurality of regions within a second air gap of the DMF cartridge seated in the seating region.

Any of these apparatuses may include a plurality of thermally conductive vias coupling the plurality of light-absorbing regions to the plurality of regions of the seating region. These apparatuses may also include a plurality of thermal sensors configured to provide thermal data to the controller.

For example, described herein are digital microfluidic (DMF) apparatuses, and particularly air-gap DMF apparatuses (although not limited to air-gap DMF apparatuses) that include photonic heating. In some variations a DMF apparatus may be configured to provide photonic heating without illuminating the droplet being manipulated. A DMF apparatus may include: a first support having an upper surface and a lower surface; wherein the upper surface comprises a plurality of electrowetting drive electrodes; wherein the lower surface comprises a plurality light-absorbing regions; wherein each light absorbing region is thermally coupled to one or more regions of the upper surface by one or more thermally conductive vias; a plurality of light emitters disposed beneath the first support and separated from the first support by an air gap, wherein each light emitter of the plurality of light emitters are configured to emit light into the air gap to heat one or more light-absorbing regions; a plurality of thermal sensors; and a controller configured to receive input from each thermal sensor of the plurality of thermal sensors and to control the light emitted by one or more of the plurality of light emitters to regulate a temperature of one or more of the one or more regions of the upper surface.

The first support may be a printed circuit board (PCB) or other rigid or semi-rigid support. In some variations, drive electrodes (electrowetting drive electrodes) are embedded in, layered on and/or recessed flat or into the outer (upper) surface of the first support. In some variations the first support is configured as a seating surface onto which a cartridge may sit, placing a hydrophobic layer in electrical communication with the electrowetting drive electrodes, so that a droplet may be moved within an air gap formed in the cartridge, e.g., on top of a sheet of dielectric material of the cartridge. In some variations the plurality of electrowetting drive electrodes stand proud of the first support; alternatively the drive electrodes may be recessed and/or flush with the upper surface.

The lower surface on the back of the first support may include the plurality of light-absorbing regions. Each region maybe formed as a layer, coating, etc. on the lower surface. Alternatively or additionally each light-absorbing region may be integrally formed on or in the lower surface.

The thermally conductive vias may be configured to connect the light-absorbing region(s) on the second, e.g., back, surface of the first support with a region of or in the upper surface. These regions may be thermal control regions and may include, encompass or be defined by the one or more drive electrodes. For example, in some variations the thermally conductive vias may connect to one or more drive electrodes.

The plurality of light emitters may be positioned within an inner air gap behind the drive electrodes and the first support. In some variations this second region may be closed off (e.g., sealed, enclosed, etc.) from the rest of the apparatus, and particularly the upper or outer surface of the first support. This inner air gap region may not be configured to drive a droplet within via electrowetting.

The controller may be part of any of the DMF systems described herein. The controller may be a photonic heating controller or it may be a controlled configured and intended to control the DMF in addition to the photonic heating of one or more regions. In some variations the controller may separately address any of the individual heating regions (e.g., regions of or adjacent to the upper surface. As mentioned, the photonic heating may be applied with feedback from one or more thermal sensors that may form part of a control loop to regulate the temperature with precision (e.g., +/−1 degree, 0.7 degrees, 0.5 degrees, 0.2 degrees, etc. or less). Multiple regions may be controlled in parallel and/or sequentially. The multiple regions may be all of the regions or subsets of the regions. Regions may be separate or may be coupled together.

For example, each thermal sensor of the plurality of thermal sensors may be configured to detect a temperature of one or more of the light-absorbing regions, thermally conductive vias or the upper surface. Each thermal sensor of the plurality of thermal sensors may be paired with a light emitter of the plurality of light emitters. All or some of the thermal sensor of the plurality thermal sensors may comprise a blackbody detector, thermistor, etc.

Any appropriate light emitter may be used. For example, the light emitter of the plurality of light emitters may include one or more of: one or more (e.g., a plurality of) LEDs or optical fibers. The plurality of light emitters may each configured to emit light having a wavelength at least in part from 800 nm to 1000 nm.

Any of the apparatuses described herein may also include one or more (e.g., an array of) optical components such as lenses, optical fibers, etc. to focus, aim, limit, filter, etc. light from one or more of the plurality of light-absorbing elements. For example, any of these apparatuses may include a focalizer on some or all of the light emitters that is/are configured to direct each of the plurality of light emitters to selectively illuminate at least one of the light absorbing regions of the plurality of light absorbing regions.

Each of the light-absorbing regions of the plurality of light absorbing regions may be configured to convert absorbed light energy to thermal energy. For example, each of the thermally conductive vias may be configured to thermally couple one of the light absorbing regions of the plurality of light absorbing regions with one or more of the actuation electrodes of the plurality of actuation electrodes.

Any of the apparatuses described herein may include a plurality of light-absorbing regions and subsequent thermal control regions. For example, any of the apparatuses described herein may comprise 10 or more regions (e.g., 15 or more regions, 20 or more regions, 30 or more regions, 40 or more regions, 50 or more regions, 60 or more regions, etc.) of the upper surface that are thermally regulated. For example, the controller may be configured to selectively control each of these thermal control regions (e.g., each of the 10 or more, 15 or more 20 or more, 30 or more, 40 or more, 50 or more, 60 or more, etc., regions of the upper surface).

Any appropriate light-absorbing region may be used. For example, the light-absorbing region may comprise a black soldermask or graphite heat-spreading material. The graphite may be configured as a heat-spreading material that may be disposed upon the second surface of the first support in selected regions around each of the plurality of thermal vias.

Similarly, the thermally conductive vias may be formed of any appropriate material. For example, a thermally conductive via may be formed of a thermally conductive metal or polymer.

As mentioned the or more supports may be a PCB.

The plurality of light emitters may be coupled to a second support extending parallel to the first support. The second support may comprises a PCB.

The controller may include a microprocessor. The controller (including the microprocessor) may be configured to adjust power applied to the light emitters based at least in part on feedback from the plurality of thermal sensors.

Any of these apparatuses may include a cooler within the temperature-regulating air-gap. For example, the cooler may be a cooling means. The cooler may include one or more fans configured to push cooling gas along the lower surface of the first support within the temperature-regulating air-gap; one or more negative pressure sources configured to draw cooling gas along the bottom surface of the first support; or a compressor configured to push cooling gas along the bottom surface of the first support. The cooler may include an electrostatic fluid generator configured to ionize particles in the temperature-regulating air-gap to enable air movement.

Any of these DMF apparatuses may include a droplet-manipulating region configured as a second air gap above the upper surface.

Any of these apparatuses may include or be configured to work with a removable/replaceable cartridge configured for droplet manipulation and disposed adjacent to the plurality of actuation electrodes disposed on the upper surface of the first support. The cartridge may include a lower dielectric material that is configured to be secured down onto the first support and the drive electrodes. The cartridge may include e a ground or return electrode. In some variations the cartridge does not include the drive electrodes, which may be on the separate DMF apparatus.

For example, a digital microfluidic (DMF) apparatus may include: a first support having an upper surface, a lower surface and a thickness therethrough, comprising a plurality of electrowetting drive electrodes disposed on the upper surface, a light-absorbing region disposed on the lower surface, and a plurality of thermally conductive vias disposed between the lower surface and the upper surface and passing through the thickness, the plurality of thermally conductive vias configured to heat a droplet disposed adjacent to the upper surface of the first support; a second support comprising an upper surface adjacent to the lower surface of the first support, wherein a plurality of light emitters and a plurality of thermal sensors are disposed on the upper surface of the second support, each of the plurality of light emitters configured to illuminate one or more locations of the light-absorbing region on the lower surface of the first support; wherein the first support and the second support are coupled together to form a temperature-regulating air-gap between the lower surface of the first support and the upper surface of the second support; and a droplet-manipulating air-gap adjacent to the upper surface of the first support. Each one of the plurality of light emitters may be paired with one of the plurality of thermal sensors, wherein each thermal detector of the plurality is configured to detect a temperature of the one or more locations on the lower surface of the first support illuminated by the respective paired light emitter of the plurality.

Also described herein are methods of operating any of the apparatuses described herein. For example, a method of heating a droplet within a digital microfluidic (DMF) apparatus may include: disposing a droplet adjacent to a location of an upper surface of a first support, wherein the upper surface comprises a thermally conductive via underlying the droplet, the thermally conductive via passing through a thickness of the first support adjacent to a lower surface of the first support; illuminating a selected location of the lower surface of the first support adjacent to the thermally conductive via, wherein the lower surface comprises a light-absorbing region configured to receive light energy; converting the light energy to thermal energy, thereby heating the thermally conductive via; and conducting the thermal energy through the thermally conductive via to the location of the upper surface of the first support, thereby heating the droplet.

The illuminating the selected location of the lower surface of the first support may include activating one or more light emitters disposed adjacent to an upper surface of a second support, the upper surface of the second support spaced apart from the lower surface of the first support by a temperature-regulating air-gap. Activating the one or more light emitters may include selectively activating at least one of the one or more light emitters to illuminate only the selected location of the lower surface of the first support. Activating each of the one or more light emitters may further comprise activating each of the one or more lights emitters to selectively illuminate one of more than one pre-selected regions of the lower surface of the first support, wherein each of the one or more light emitters is configured to illuminate the more than one pre-selected regions of the lower surface of the first support.

In some variations, heating the droplet further comprises controlling the heating to heat the droplet to a selected temperature. Controlling the heating may further comprise detecting the temperature of the selected location of the lower surface of the first support.

Detecting the temperature of the selected location of the lower surface of the first support may comprise detecting reflected heat from the selected location by a thermal detector disposed adjacent to the upper surface of the second support. Alternatively or additionally, detecting the temperature may include using a thermistor or other temperature sensor on or in the first support.

In some variations, controlling the heating further comprises activating or deactivating at least one of the one or more light emitters based at least in part upon feedback from the thermal detector. The thermal detector may be disposed adjacent to the at least one of the one or more light emitters (a thermal detector and thermal sensor may refer to the same apparatus or part of the same apparatus).

Any of these methods may also include turning off the at least one of the one or more light emitters when a selected temperature is detected. The controller may generally include controlling the light emitters by controlling the power (current, voltage, both current and voltage) to each, some or all of the light emitters of the plurality of light emitters. In some variations the light emitters may be controlled by adjusting the frequency of the applied energy and therefore the frequency of the applied current and/or voltage may be adjusted.

Heating the droplet may further comprise maintaining a selected elevated temperature for a selected period of time.

Any of these methods may also include cooling the droplet after a selected period of time of heating. Cooling the droplet may comprise introducing cooling gas across the lower surface of the first support, thereby disbursing heat from the droplet. Introducing cooling gas may include drawing or pushing gas across the lower surface of the first support. For example, cooling the droplet may include ionizing particles within a gas in a temperature-regulating air-gap below the lower surface of the first support to accelerate movement of the gas within the temperature-regulating air-gap, thereby disbursing heat from the droplet. Any of these methods may also include disposing a plurality of droplets adjacent to a plurality of locations of the upper surface of the first support, wherein the upper surface comprises a plurality of thermally conductive vias underlying each of the plurality of droplets; and heating each of the plurality of droplets.

The method may also or alternatively include disposing a plurality of droplets adjacent to a plurality of locations of the upper surface of the first support, wherein the upper surface comprises a plurality of thermally conductive vias underlying each of the plurality of droplets; and heating a selected subset of the plurality of droplets.

Heating each of the plurality of droplets may include illuminating a plurality of locations on the lower surface of the first support, and heating the plurality of thermally conductive vias underlying the plurality of droplets. The heating may be performed simultaneously at each location of the plurality of locations. The plurality of thermally conductive vias may include any appropriate number (e.g., 10 or more, 15 or more, 20 or more, 30 or more, 40 or more, 50 or more, 50 or more, etc.) of thermally conductive vias. In some variations 96 or 384 thermally conducive vias may be used.

Illuminating the plurality of locations on the lower surface of the first support may include activating a plurality of light emitters disposed adjacent to an upper surface of a second support, the upper surface of the second support spaced apart from the lower surface of the first support by a temperature-regulating air-gap.

Any of the method described herein may also include cooling each of the plurality of droplets after a selected period of time of heating.

The method may also include performing a selected number of cycles of heating and cooling the plurality of droplets.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings of which:

DETAILED DESCRIPTION

In general, described herein are digital microfluidic (DMF) apparatuses that include a plurality of DMF drive electrodes that further include one or more thermally controlled region that at photonically heated and may be actively or passively cooled; the photonic heating may be performed from within the device.

Figure 1:
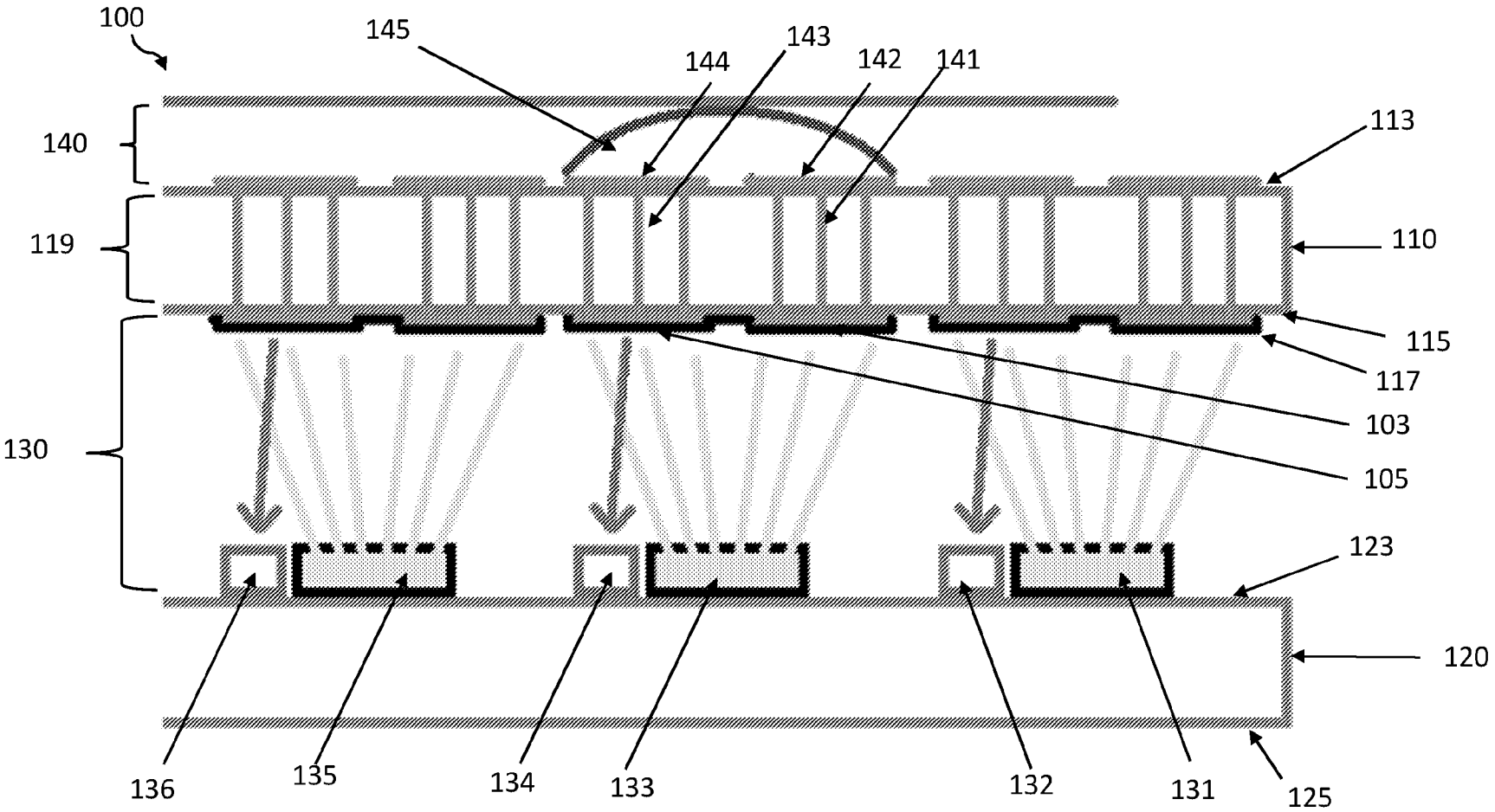
FIG. 1 is a graphical representation of a microfluidic apparatus according to some embodiments of the disclosure.

FIG. 1 shows an exemplary DMF apparatus 100, which has two supports, 110, 120, which may be PCBs, which function together to provide transport and heating/cooling to the droplet 145. Support 110, has an upper surface 113, and a lower surface 115, and a thickness therethrough 119. The upper surface 113 is the droplet manipulation surface 113, and faces the droplet-manipulating region 140. Droplet-manipulating region 140 may be oil-filled or it may be a droplet-manipulating air-gap (e.g., air-filled). In particular, the air-gaps described herein may be large air-gaps (e.g., greater than 280 micrometers, greater than 300 micrometers, >400 micrometers, >500 micrometers, >600 micrometers, or more. The droplet manipulation surface 113, in some variations, may interface with a disposable cartridge (not shown) disposed and secured upon the droplet manipulation surface 113. In any case, droplet 145 is disposed adjacent to the droplet manipulation surface 113 upon which a plurality of actuation electrodes 142, 144 is disposed. Thermally conducting vias 141, 143 have a first end adjacent to the lower surface 115, passing through the thickness 119 of the support 110, and have a second end adjacent to the surface 113, at an actuation electrode 142, 144 of support 110. There may be any number of thermally conducting vias, providing heating at any number of regions adjacent to the upper surface 113. There may be about 10, 25, 50, 75, 96, 100, 200, 300, 284 heating regions or more upon the surface 113. There is a layer of light-absorbing material 117 on the lower surface 115, which may be continuous (as shown) or which may be discontinuous, e.g., pads of light-absorbing material about and adjacent to the second end of the thermal vias 141, 143. The light-absorbing material may be any suitable material, including but not limited to black soldermask and graphite heat spreader material.

Illumination of regions 103, 105 of the light-absorbing region 117, transfer the thermal energy obtained from the illumination, to the thermally conductive vias 141, 143. The thermal energy is transferred from the first end of the thermally conductive vias 141, 143 to the second end of the vias adjacent to the actuation electrodes 142, 144 at the surface 113. The thermal energy is transferred to droplet 145 and heats it.

The apparatus includes a specific arrangement that permits illumination (light energy) to be provided selectively to location(s) on the light-absorbing region 117 of the lower (e.g., bottom) surface of the support 110. A second support 120, which may be a PCB, is disposed, having an upper surface 123, facing the lower surface 115 of the first support 110 with a temperature-regulating air-gap between. The temperature-regulating air-gap 130 may have a vertical dimension between surface 123 and surface 115 greater than 280 micrometers, greater than 300 micrometers, >400 micrometers, >500 micrometers, >600 micrometers, >700 micrometers, >800 micrometers, >1000 micrometers or more. In some variations, supports 110, 120 are coupled together to fix the temperature-regulating air-gap distance. Disposed upon the upper surface 123 of the second support 120 is a plurality of light-emitters 131, 133, 135. The light-emitters 131, 133, 135 may be LEDs, fiber optic fibers, or any suitable light-emitter. In some variations, the plurality of light-emitters may be generated from a single light source and split to emit light at the plurality of positions 131, 133, 135. The light-emitters may emit light in any desired wavelength range, e.g., from about 250 nm to about 100 nm. In some variations the light-emitters may emit light having a wavelength of about 800 nm to about 100 nm, or may emit light which, at least in part, emit light having a wavelength of about 800 nm to about 100 nm. In some variations, broad spectrum lights may be utilized, as generating a large amount of energy in one frequency can reduce efficiencies of transmission and absorption. The light-emitters 131, 133, 135 may be configured to illuminate one or more regions located on the light absorbing layer 117. For example, light-emitter 133 is configured to illuminate one or both of regions 103, 105 of the light-absorbing region 117, adjacent to thermally-conductive vias 141, 143. In some variations, the light-emitter 133 may include a pointing mechanism to direct the emitted light to one of several different locations. In some variations, the light-emitter 133 may be selectively activated to illuminate only one of regions 103, 105. Additionally, only one of light-emitters 131, 133, 135 may be selectively activated to emit light or any combination of light-emitters may be activated at the same time.

Figure 2:
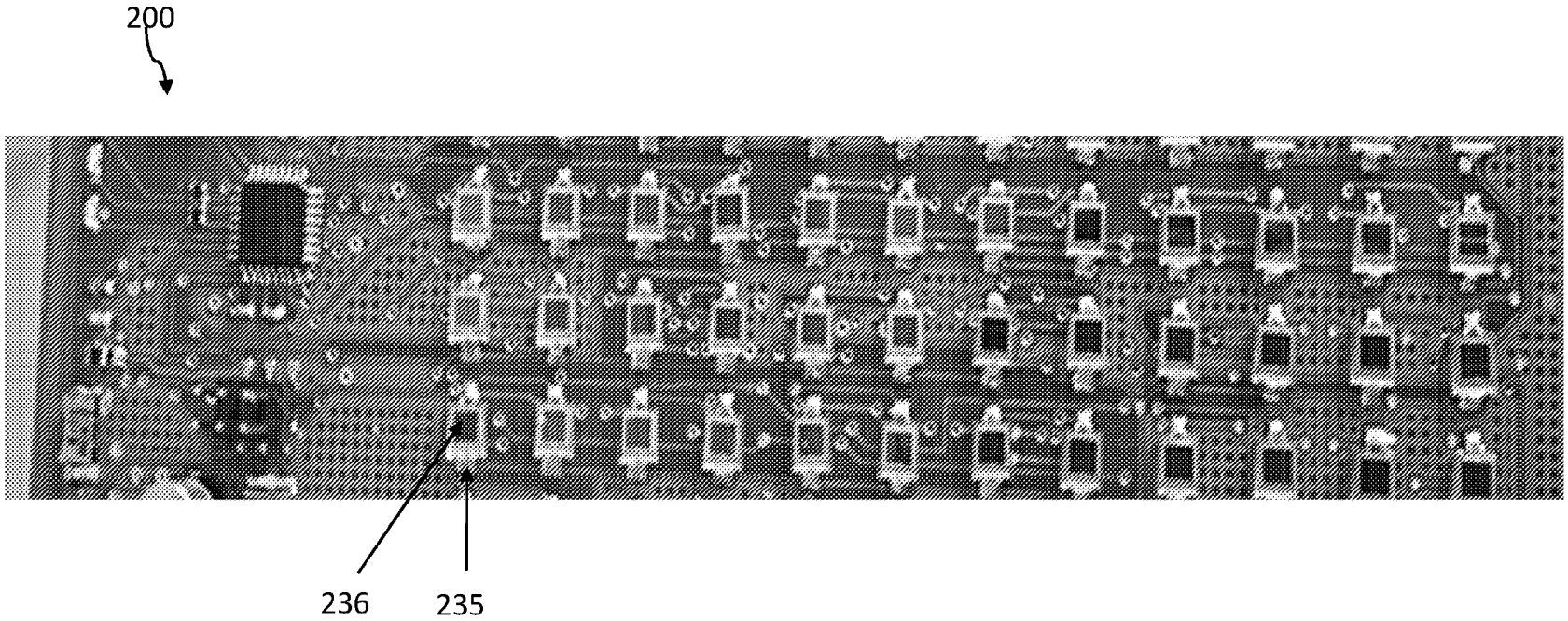
FIG. 2 is a photographic representation of a portion of a lower support including light emitters and black-body thermal sensors according to some embodiments of the disclosure.

Thermal sensors 132, 134, 136 are disposed on the surface 123, and are disposed adjacent to each of a light-emitter 131, 133, 135 and may be paired to detect the thermal energy from the one or more regions illuminated by its respective paired light-emitter. For example, thermal detector 134 may detect the thermal energy, such as the black radiation in the infrared (non-visible) region of light, which can determine temperature from regions 103 and/or 105 of the light absorbing layer 117. Since the thermally conductive vias 14, 143 are conductive, the temperature of the droplet may be determined and controlled. The thermal sensors may be included in a closed-loop feedback system in order to control the temperature of the droplet 145. FIG. 2 shows an example of the upper surface 200 of a PCB having a plurality of light emitters (one instance is labeled at 235) and black body radiation thermal sensors (one instance is labeled at 236).

Figure 3:
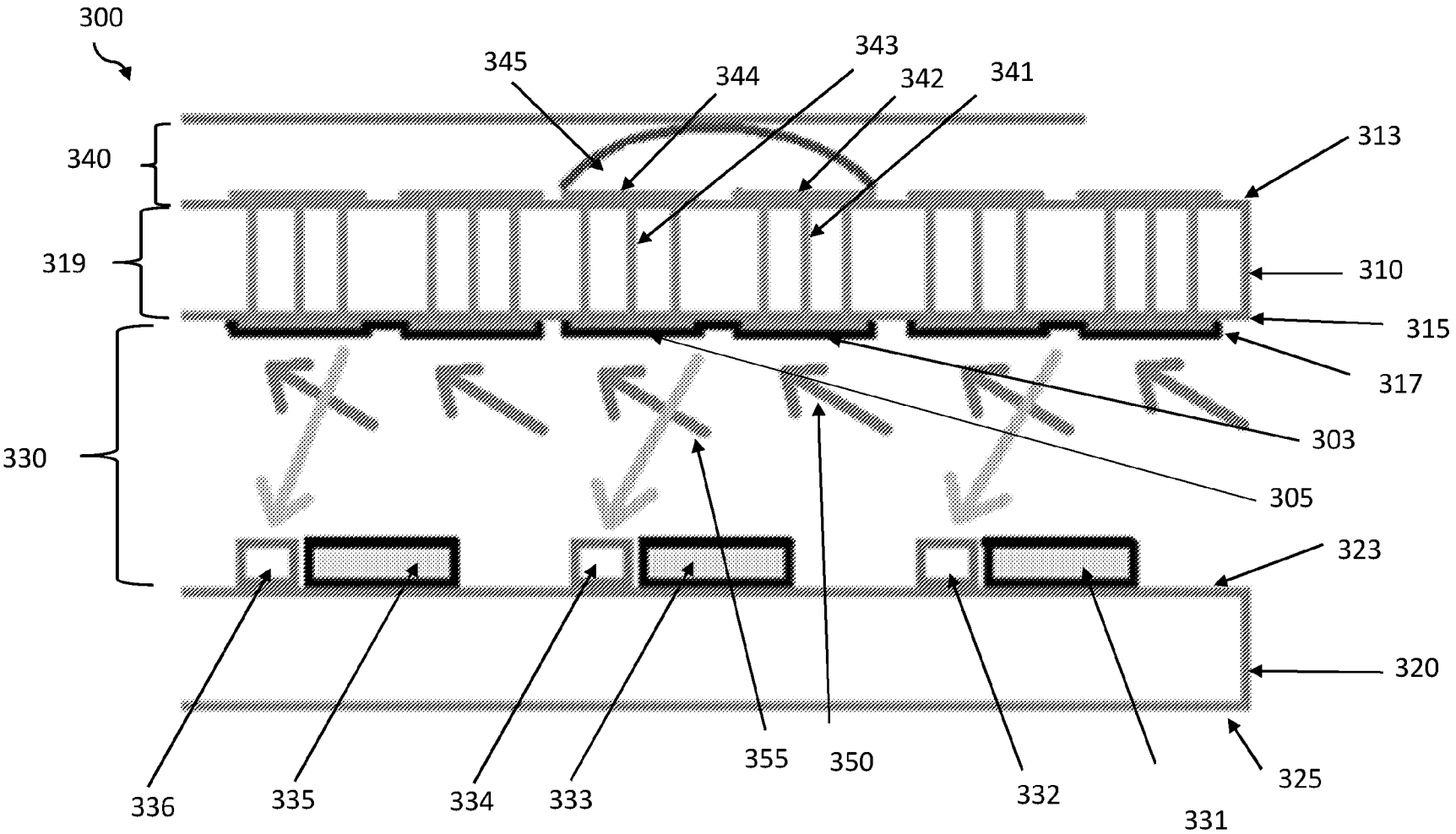
FIG. 3 is a graphical representation of a method of cooling according to some embodiments of the disclosure.

The DMF apparatus may further include components configured to cool the first support, e.g., the support having the droplet manipulation surface. Many protocols and workflows require a period of heating followed by a period of cooling, which may be repeated for any number of cycles. FIG. 3 shows the DMF apparatus 300, which is similar to apparatus 100 of FIG. 1 and may have any of the features described for apparatus 100. A droplet 345 is disposed within a droplet-manipulating air-gap above the droplet-manipulating surface (upper surface 313) of upper support 310, which may be a PCB. Actuation electrodes 342, 244, underlay the droplet 345, and thermally conducting vias 341, 343, pass through the thickness 319 of the support 310, adjacent to the lower (bottom) surface 315, and light-absorbing layer 317, and specifically adjacent to regions 303, 305 of the light-absorbing region 317. Once a desired period of heating has been completed, light-emitters 331, 333, 335 upon the upper surface 323 of the second support 320, disposed across the vertical dimension of the thermal-regulating region 330, are deactivated. Light energy is no longer delivered to the light-absorbing region 317 of the lower surface 315 of support 310, which is similar to support 110. The regions 303, 305 may cool by passive cooling, dissipating energy into the support 310. Cooling may be enhanced by pushing/drawing cooler gas/air across the underside of the support 310 (see flow arrows 350, 355). The pushing or drawing of the cooler gas may be performed by a compressor, a fan and may be coupled with a source of negative pressure to exchange cooling gas. This removes thermal energy and decreases the temperature of the support 310, thermal vias 341, 343, and the droplet 345. The change in thermal energy can be monitored by the thermal sensors 332, 334, 336. For example, thermal detector 334 can monitor the thermal energy at regions 303 and/or 305, which related to the temperature of the droplet 345, permitting determination of the temperature of the droplet 345. Once the temperature has dropped to a desired temperature an additional period of heating may be instituted by activating light-emitter 333 again.

Figure 4:
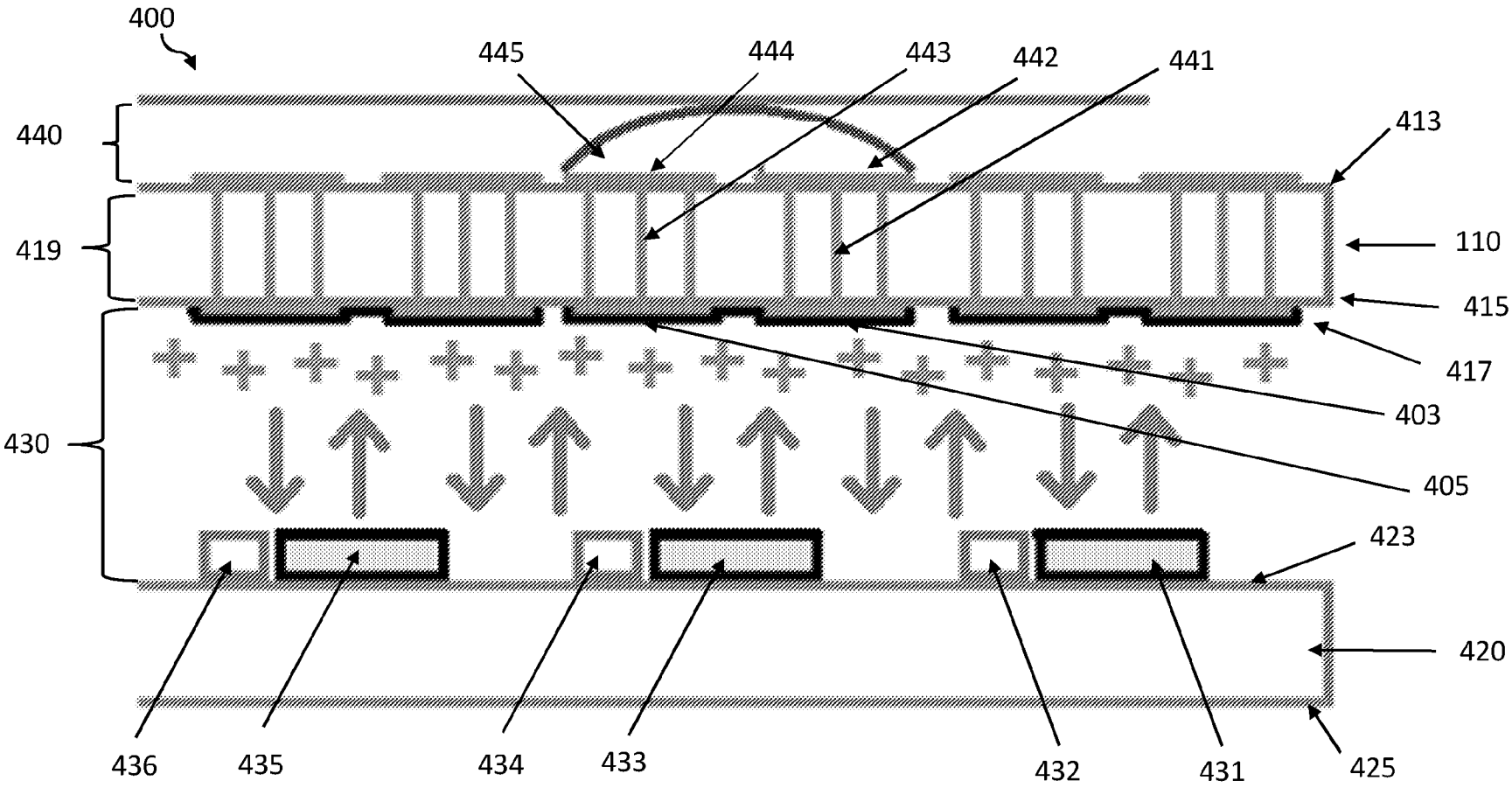
FIG. 4 is a graphical representation of a method of cooling according to some embodiments of the disclosure.

FIG. 4 shows a variation of the DMF apparatus of FIG. 3, where the cooler is configured as an electrostatic fluid generator configured to ionize particles in the temperature-regulating air-gap to enable air movement. The ionized particles move, moving the air and cooling the region to cool. Convection cooling and/or Peltier cooling may also or additionally be applied.

Figure 5:
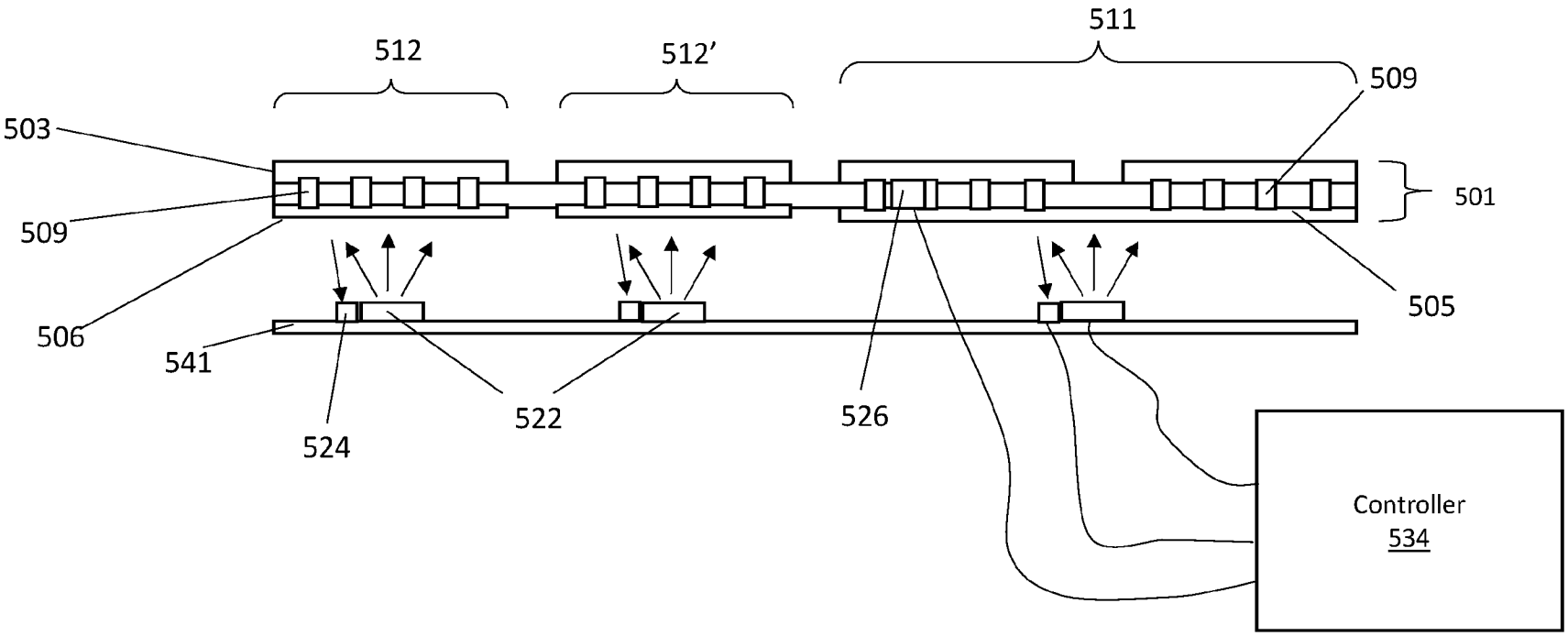
FIG. 5 is another example of a portion of a DMF apparatus configured to apply photonic heating as described herein.

FIG. 5 illustrates another example of a portion of an apparatus as described herein including a first support 501. A plurality of drive electrodes 503 are formed on top of the first support. In FIG. 5, multiple drive electrodes may be placed in thermal communication with a single light-absorbing region 505 (e.g., so that the heat/cooling will conduct between these elements and they will rapidly have the same temperature). As used herein, a light-absorbing region refers to a region comprising a material that absorbs light and coverts it to heat, typically warming based on the photonic energy applied. In FIG. 5 a plurality of thermally-conductive vias 509 conduct thermal energy from the light-absorbing region to the external surface of the first support. In this example the thermal vias are in communication with the drive electrodes, which may be thermally conductive as well, and may heat or cool as the light-absorbing region heats and/or cools. In FIG. 5, at least one large thermally controlled region 511 includes two (or more, not shown) drive electrodes. This example also shows individual, smaller, thermally controlled regions 512, 512' that are connected through the thickness of the first support via one or more vias 509 to a separate light-absorbing region 506. Each thermally controlled region may be illuminated by one or more light sources 522. The light sources may be configured to efficiently heat the light-absorbing material (e.g., so that the light is converted to heat with a high efficiency). Multiple light sources may be used to illuminate a single thermally controlled region (e.g., a single light-absorbing region). The light sources may be connected to a controller 534 that may individually and/or collectively regulate the temperature of each thermally controlled region by controlling the light source(s) and/or any coolers, as described in FIGS. 3-4, above. The controller may receive thermal (temperature) data for each thermally controlled region and/or a droplet above the thermally controlled region. For example one or more thermal sensors may be included per thermally-controlled region. A blackbody detector 524 may be included and/or a thermistor 526. These temperature sensors may provide feedback to the controller to regulate the temperature of the thermally controlled region and therefore any droplet that is adjacent to the thermally controlled region on the upper surface (even through a dielectric material placed over the upper surface, not shown). The controller may be part of the lower, second support 541 (e.g. PCB) as may the light sources and/or thermal sensors.

In general, the methods and apparatuses described herein are DMF apparatuses that may include photonic heating as part of the control system for controlling localized temperature control of one or more (preferably a plurality of) DMF regions, such as regions within an air gap in which one or more droplets may be moved the DMF apparatus. Any appropriate DMF apparatus may be configured and/or operated as described herein to include photonic hating. For example, the apparatuses (systems, devices, etc.) described in PCT/US2020/02025, filed on Feb. 28, 2020, and herein incorporated by reference in its entirety, may include photonic heating as described herein.

Figure 6A:
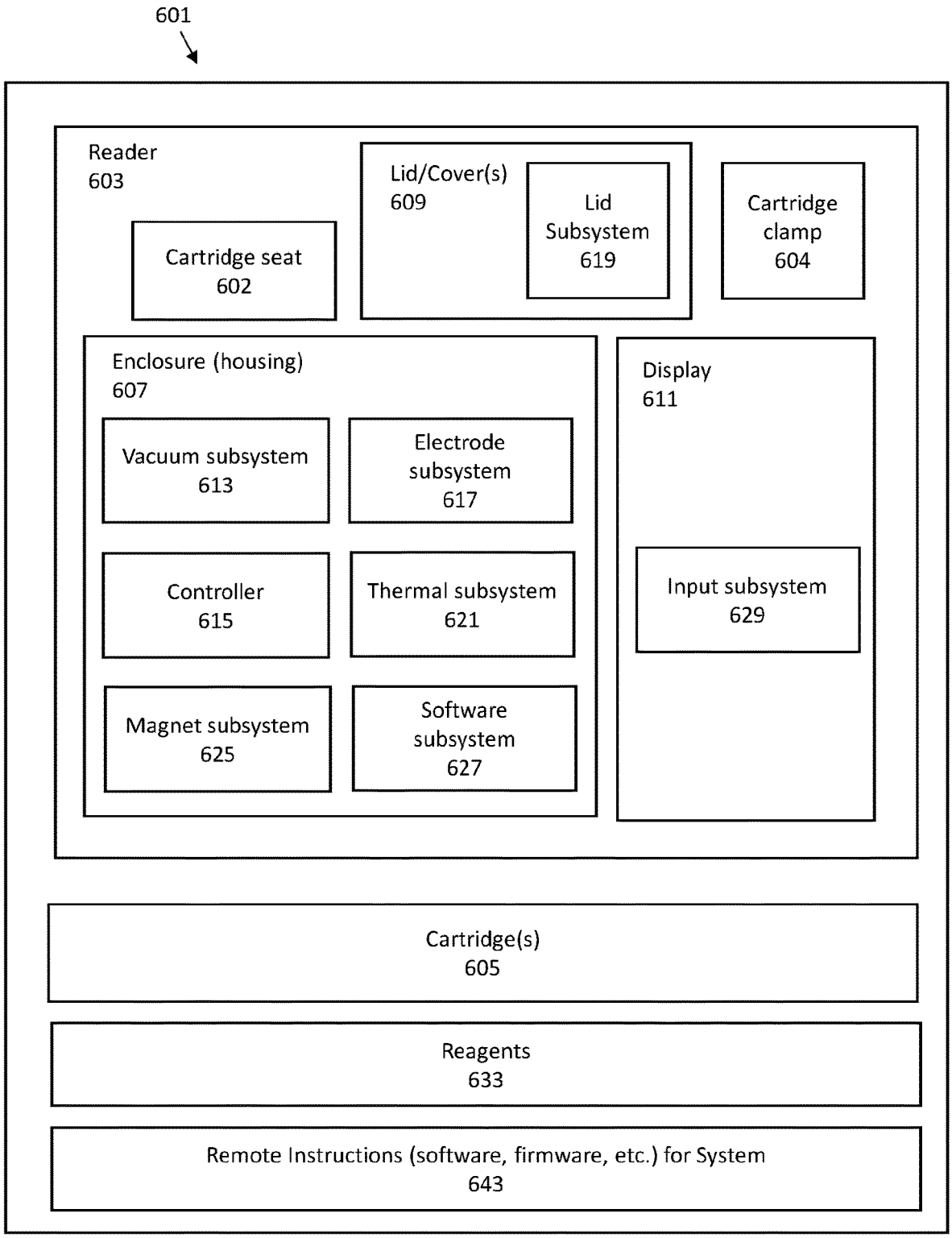
FIG. 6A schematically illustrates one example of an apparatus (e.g., a DMF apparatus) configured to include photonic heating as described herein.

For example, FIG. 6A illustrates one example of a digital microfluidic (DMF) apparatus that may be configured to provide local/regional temperature control within a DMF reaction region (e.g., air gap). In FIG. 6A the apparatus (e.g., a system 601) include a DMF reader 603. The apparatus may be configured for use with or may include: one or more cartridges 605 and one or more reagents 633. The reader may include software, firmware or the like 643 that may be run remotely (e.g., desktop, laptop, mobile device, pad, etc.) for communication with, controlling, and/or creating, transmitting or modifying protocols and other operational parameters of the system (e.g., the DMF apparatus, or a reader 603). The reader may refer to the DMF apparatus that controls the application of energy (e.g., voltage) to drive droplets for processing the droplets, including controlling the temperature and/or magnetic field. In this example, the reader 603 is adapted to receive the cartridge(s) into a seat 602 and secure the cartridge, e.g., using one or more keyed regions and/or a vacuum to both orienting and secure the cartridge in the seating region. The reader may include a lid or cover 609 that may include and/or enclose a lid subsystem 619. The reader may also include a cartridge clamp 604 that may act as a safety lock or interlock when a cartridge is held within the cartridge seat. The cartridge clamp may be part of the lid or lid system, or it may be separate. The reader in FIG. 6A may also include a housing or enclosure 607 that may fully or partially cover a controller 615 (including one or more processors, circuitry, clock, power regulators, wireless communication circuitry, memory, etc.), and the one or more subsystems controlling operation of the DMF and microfluidics on the cartridge. The controller may include a microcontroller, input interface (e.g., touchscreen, button, knob, etc.) circuitry, output interface (e.g., Ethernet, WiFi, etc.), etc. The reader may also include, e.g. within the housing, a vacuum sub-system 613, an electrode sub-system 617, a thermal control sub-system 621, a magnet control sub-system 625 and/or a software sub-system 627; any or all of these sub-systems may communicate and/or be coordinated by the controller.

For example, the vacuum sub-system may include a vacuum chuck, a vacuum pump, and one or more pressure sensors for detecting (and/or providing feedback to control the vacuum) pressure. The software subsystem may include software, hardware or firmware, such as a non-transitory computer-readable storage medium storing a set of instructions capable of being executed by the one or more processors of the controller to coordinate operation of the systems, including any of the sub-systems. The thermal subsystem may include the TECs, heat sinks/fans, and one or more thermal sensors (including thermal sensors configured to monitor temperature of the cartridge, e.g., the air gap region and/or one or more thermal sensors configured to monitor the temperature of/within the housing, of the TECs, etc.). The magnetic subsystem may include, for example, one or more magnets (such as one or more Halbach array magnets), one or more actuators for all or some of the magnets and one or more position sensors for monitoring/detecting the position of a magnet (e.g., a home sensor).

The housing may be connected to, and/or may partially enclose one or more inputs and/or outputs 611, such as a display and input subsystem 629. The display may be a touchscreen and/or one or more buttons, dials, etc.

An electrode sub-system may include the array of drive electrodes (e.g. an electrode array) underlying the cartridge seat, one or more high-voltage drivers, one or more TEC driver, a safety interlock, one or more resistive heaters, etc.

The lid may couple to the housing and may at least partially enclose the lid subsystem, as mentioned above. The lid sub-system may include, for example, one or more pipette pumps, a vacuum manifold, one or more solenoid valves, one or more pressure sensors, one or more positional sensors, and one or more indicators (e.g., LEDs, etc.). The lid may be hinged to close over the cartridge and against the housing; this lid (and the cartridge clamp) may, separately, lock over the cartridge when it is loaded into the reader, and may be hinged to the housing. As mentioned, the cartridge clamp may be coupled to the housing and may be covered by the lid.

As descried herein the apparatus (e.g., the "reader") may include a thermal subsystem 621 that may include a plurality light-absorbing regions thermally coupled to a plurality of regions of the seating region (cartridge set 602) and a plurality of light emitters separated from the seating region by an internal air gap. Each light emitter may be configured to emit light into the air gap to heat one or more of the light-absorbing regions.

Figure 6B:
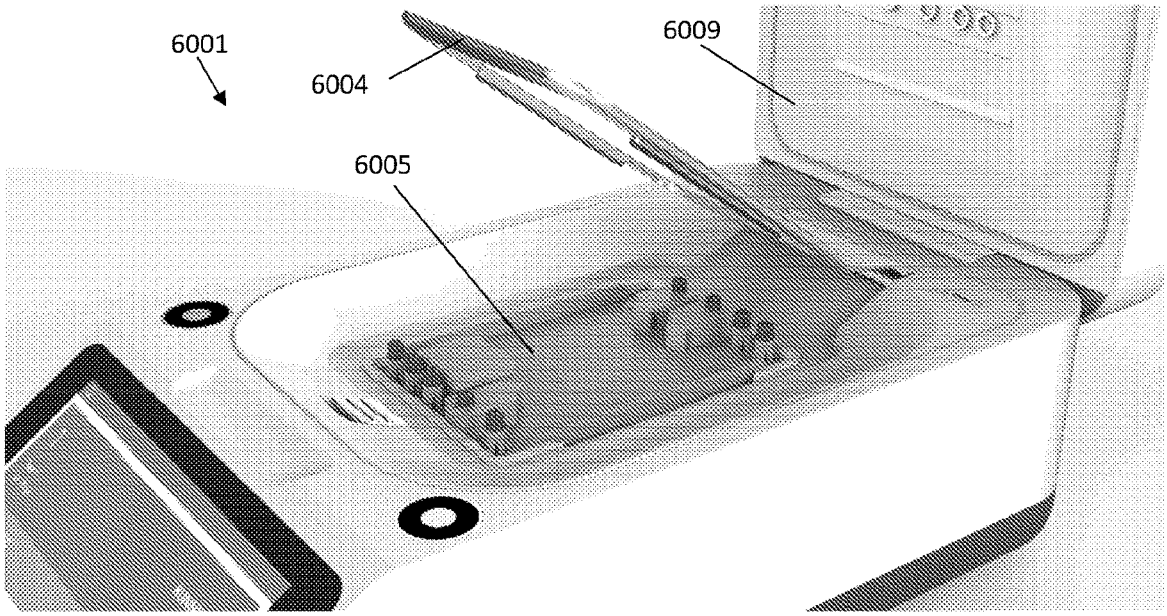
FIGS. 6B-6C illustrate one example of a DMF apparatus configured to provide photonic heating as described herein.
Figure 6C:
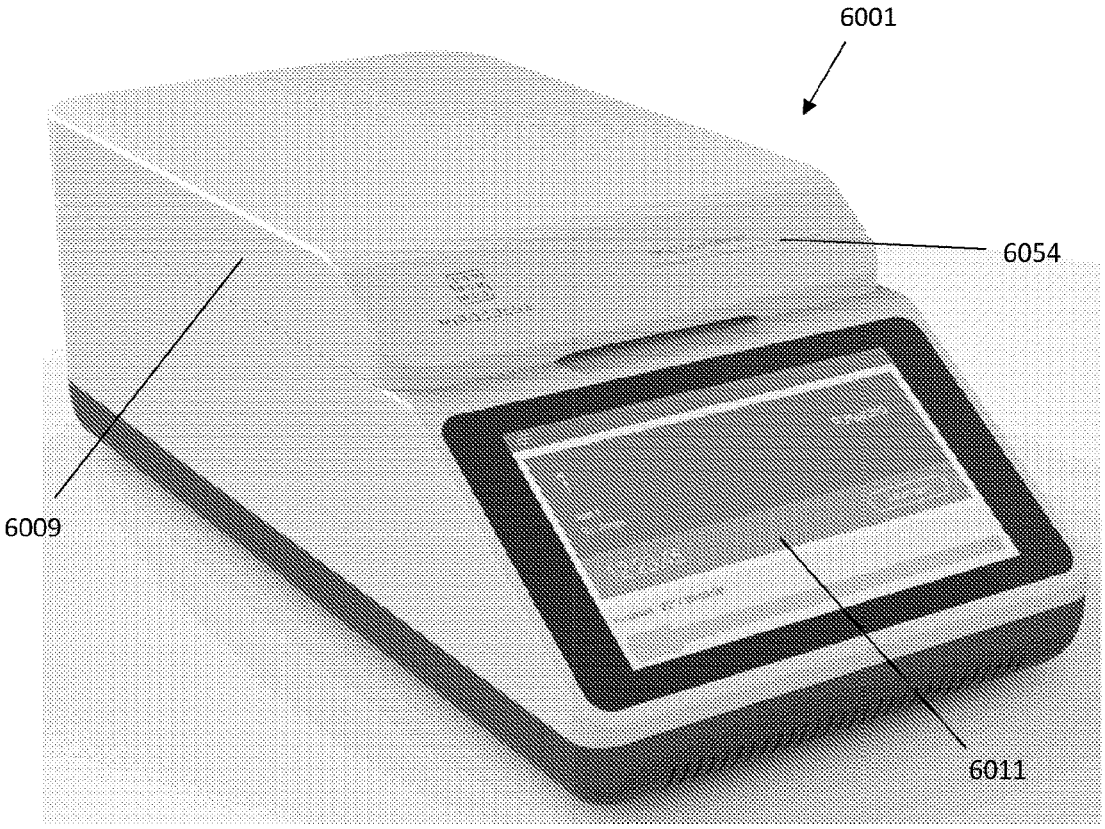

FIGS. 6B and 6C illustrate one example of DMF apparatus (or reader) that may be configured to include photonic heating as described herein. In FIG. 6B, the DMF apparatus 601 is shown with the lid open (FIG. 6C shows the same apparatus with the lid down). In FIG. 6B, the reader 6001 may include any of the features described herein, including the thermal subsystem features such as the light-absorbing region(s) on the underside of the seating region for holding a removable cartridge 6005. In FIG. 6B, showing the apparatus with the lid 6009 open, but the clamp 6004 latched closed, a cartridge 6005 is held within the seating region of the housing of the reader. In this state the high-voltage power to the drive electrodes may be 'on' and droplets may be moved or held in position using the drive electrodes (e.g., via electrowetting). This may prevent undesired movement of droplets or fluid in the cartridge when loading/unloading fluid. Safety interlocks may mitigate the risk of electrical shocks to a user applying liquid to the cartridge. For example, the clamp may cover the edges of the cartridge, so that only the upper surface (electrically isolated from the high-voltage drive electrodes) is exposed. The clamp latch may detect engagement and locking of the latch; the system may be configured to prevent voltage until and unless the clamp is latched. Other safety interlocks may also or alternatively be used. In this example the clamp latch is disengaged, and the clamp is shown raised to allow removal of the cartridge. Removal of the cartridge exposed the drive electrodes and thermally conductive regions connected by one or more vias (thermally conductive vias) to the light absorbing regions.

In FIG. 6C, the reader device 6001 is shown in with the lid 6009 closed, and locked, and the high-voltage engaged, as shown by the indicator 6054 on the lid. A cartridge has been inserted, and the touchscreen 6011 on the front of the device indicates the status of the reader and cartridge.

Although the example apparatus shown in FIGS. 6A-6C is configured for use with a removable cartridge holding an air gap within which the droplet(s) may be moved, any of the apparatuses described herein may instead by configured with an integrated air gap and/or for use with an oil gap within which the droplet is moved by DMF.

Figure 7:
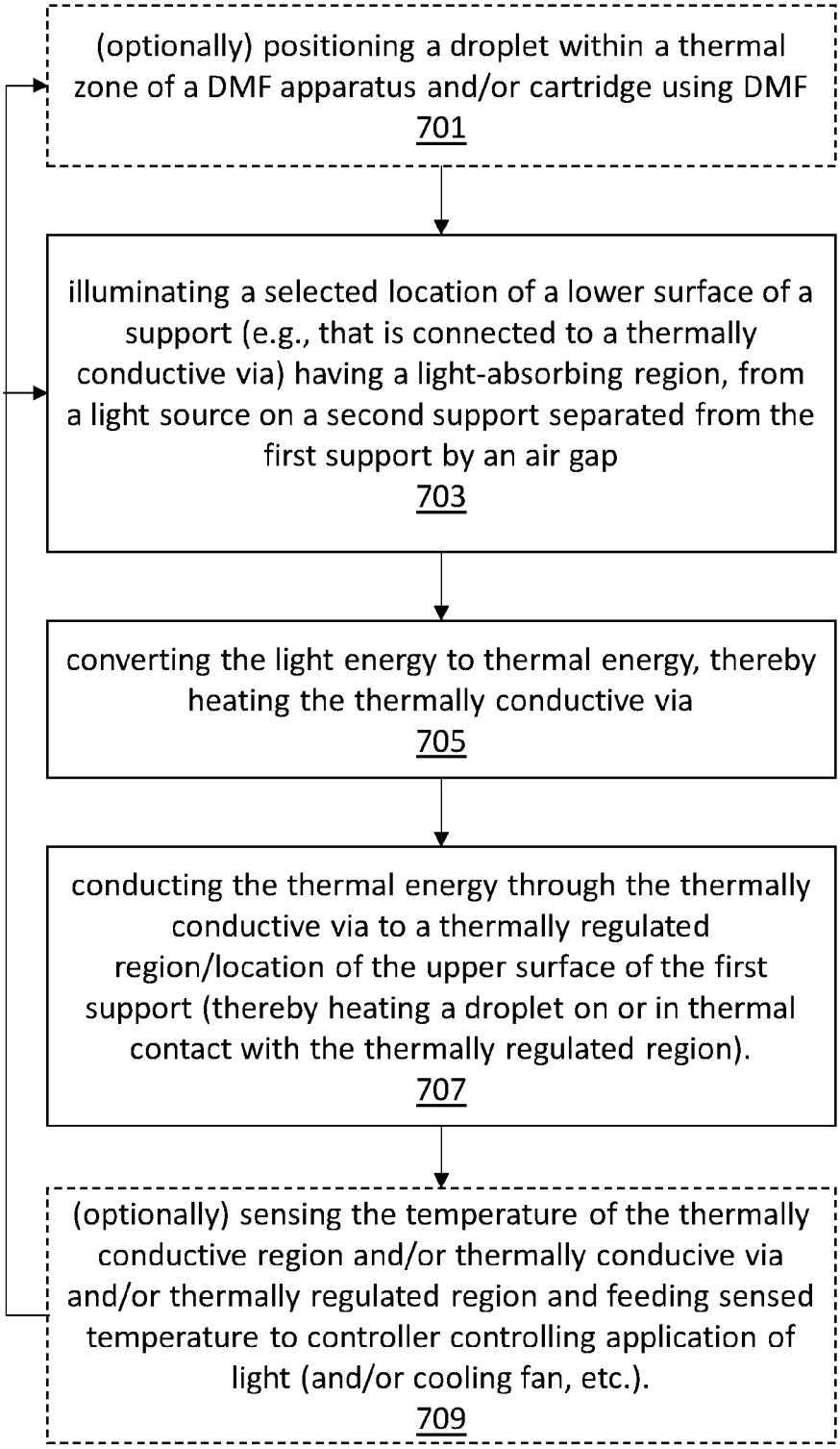
FIG. 7 schematically illustrates one variations of a method as described herein.

In operation, any of the apparatuses described herein may be used to process a droplet, or multiple droplets either in parallel (e.g., at the same time) and/or sequentially. For example, FIG. 7 illustrates one example of a method of controlling the temperature of sub-regions of a DMF apparatus using photonic thermal zones that can heat (enabling isothermal incubations) and cool fast. This method may be a method of heating a droplet within a digital microfluidic (DMF) apparatus, and/or a method of processing a droplet using DMF. Initially, one or more droplets may be positioned with a thermal control zone (or optionally, multiple droplets within multiple thermal control zones) 701. Alternatively or additionally, the temperature of the thermal control zone may be regulated before a droplet is positioned within the thermal control zone. For example, a droplet may be positioned adjacent to (e.g., on top of) a thermal control region/location of an upper surface of the DMF apparatus. The upper surface may be part of a seating region for holding a DMF cartridge within which the droplet is moved. The upper surface may include a thermally conductive via underlying the thermally controlled region (and in some variations, underlying the droplet). The thermally conductive via may conduct heat from the underside of the first support adjacent to the seating region. This region may be limited to a sub-region of the seating region (and therefore a sub-region of the cartridge).

The method may include illuminating a selected location of the lower surface of the first support. This selected location may include a light-absorbing region configured to receive light energy. The region may be illuminated by any appropriate light source, across an air gap region 703. The light emitted may be absorbed by the light-absorbing material and converted into heat 705. Examples of light-absorbing materials are provided herein, and may be coordinated with the applied wavelength, so that light is absorbed in a specific wavelength or range of wavelengths. In some variations different regions may include different light-absorbing materials that may absorb at different wavelengths. The light sources may then be controlled to emit specific wavelengths to heat select regions that match the emitted wavelength(s).

The heat generated by absorbing the light energy may then be transmitted through the support to the upper side by one or more thermally conductive vias. For example, the heat may be transmitted by a thermal via to a location on the upper surface of the support 707, thereby heating a droplet in thermal contact with this region/portion of the upper surface.

In some variations the droplet may be moved into a heated region. Alternatively or additionally, a droplet may be moved from the heated region to a second region that is not heated or a second region that is heated to a different temperature.

These methods may also include cooling one or more regions. For example, the air gap region between the support and a second support holding the light sources may be cooled (e.g., by a fan, etc.) as described above.

Any of the steps of these methods may also include monitoring the temperature of one or more of: the thermally conductive region, the thermally conductive via, and/or the thermally regulated region 709. The sensed temperature may then be provided as feedback to the controller that may adjust one or more of: the applied light, (turning it on/off or increasing/decrease the amount of light emitted), and/or cooling (e.g., a fan, negative pressure source, compressor, etc.). Thus the controller may regulate the temperature of the one or more regions.

Any of the apparatuses described herein may include an array of heaters and thermal sensors throughout the underside of the PCB (see, e.g., FIG. 2) and may offer the possibility to actuate some or all of them at once (enabling simultaneous parallel heating of multiple zones on DMF) or on demand, in select combinations or even one at a time in a sequential fashion. These photonic thermal zones can heat (enabling isothermal incubations) and cool fast, enabling regular thermocycling and even ultra-fast PCR.

The availability of "on demand" heaters across the surface of the DMF PCB as described herein may radically simplify the routing of droplets/reagents in complex, multistep protocols or high-plex operations. More specifically, these methods and apparatuses may give the path finding algorithm, which may schedule and determine which components get manufactured most broadly freedom to route reagents focusing solely on reagent cross-contamination rules without having to consider HW limitations such as a fixed positions of TEC heaters under the DMF PCB. With this flexibility the DMF cartridge can offer an on-demand a large number of independently controlled thermally-regulated regions (e.g., each corresponding to, e.g., 96 or 384 reaction well plate equivalent (for plexing reactions) or host complex, multi-step workflows such as: cell culture followed by either transfection/transformation or cell→cell based assay→cell isolation→cell lysis→library preparation for NGS or target molecule detection end point reactions (such as RT-qPCR or qPCR).

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

Throughout this specification and the claims which follow, unless the context requires otherwise, the word "comprise", and variations such as "comprises" and "comprising" means various components can be co-jointly employed in the methods and articles (e.g., compositions and apparatuses including device and methods). For example, the term "comprising" will be understood to imply the inclusion of any stated elements or steps but not the exclusion of any other elements or steps.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A digital microfluidic (DMF) apparatus, comprising:

a seating region configured to seat a DMF cartridge thereon;

a plurality of electrowetting drive electrodes in electrical communication with the seating region;

a plurality of light-absorbing regions thermally coupled to a plurality of regions of the seating region;

a plurality of light emitters separated from the seating region by a first air gap, wherein each light emitter is configured to emit light into the first air gap to heat one or more of the light-absorbing regions; and a controller configured to control the light emitted by each of the light emitters to regulate a temperature of each of a plurality of regions within a second air gap of the DMF cartridge seated in the seating region.

2. The apparatus of claim 1, further comprising a plurality of thermally conductive vias coupling the plurality of light-absorbing regions to the plurality of regions of the seating region.

3. The apparatus of claim 1, further comprising a plurality of thermal sensors configured to provide thermal data to the controller.

4. The apparatus of claim 3, wherein each thermal sensor of the plurality of thermal sensors are configured to detect a temperature of one or more of the light-absorbing regions, thermally conductive vias or an upper surface.

5. The apparatus of claim 3, wherein each thermal sensor of the plurality of thermal sensors is paired with a light emitter of the plurality of light emitters.

6. The apparatus of claim 1, wherein each light emitter of the plurality of light emitters comprises one or more of: one or more LEDs or optical fibers.

7. The apparatus of claim 1, wherein the plurality of light emitters are each configured to emit light having a wavelength at least in part from 800 nm to 1000 nm.

8. The apparatus of claim 1, further comprising a focalizer configured to direct each of the plurality of light emitters to selectively illuminate at least one region of the plurality of light-absorbing regions.

9. The apparatus of claim 1, wherein each of the light-absorbing regions of the plurality of light-absorbing regions is configured to convert absorbed light energy to thermal energy.

10. The apparatus of claim 1, further comprising a plurality of thermally conductive vias is configured to thermally couple one region of the plurality of light-absorbing regions with one or more actuation electrodes of a plurality of actuation electrodes.

11. The apparatus of claim 1, wherein the plurality of light-absorbing regions comprises black soldermask or graphite heat-spreading material.

12. The apparatus of claim 10, wherein the plurality of light-absorbing regions are disposed in selected regions around each of the plurality of thermally conductive vias.

13. The apparatus of claim 10, wherein one or more of the plurality of thermally conductive vias each comprise a thermally conductive metal or polymer.

14. The apparatus of claim 3, wherein the controller comprises a microprocessor configured to adjust power applied to the light emitters based at least in part on feedback from the plurality of thermal sensors.

15. The apparatus of claim 1, further comprising a cooler within the first air gap.

16. The apparatus of claim 15, wherein the cooler comprises: one or more fans configured to push cooling gas along a lower surface of a first support within the first air gap; one or more negative pressure sources configured to draw cooling gas along the lower surface of the first support; or a compressor configured to push cooling gas along the lower surface of the first support.

17. The apparatus of claim 15, wherein the cooler comprises an electrostatic fluid generator configured to ionize particles in the first air gap to enable air movement.

18. A digital microfluidic (DMF) apparatus, comprising:

a first support having an upper surface, a lower surface and a thickness therethrough, comprising a plurality of electrowetting drive electrodes disposed on the upper surface, a light-absorbing material disposed on the lower surface, and a plurality of thermally conductive vias disposed between the lower surface and the upper surface and passing through the thickness, the plurality of thermally conductive vias configured to heat a droplet disposed adjacent to the upper surface of the first support;

a plurality of light emitters and a plurality of thermal sensors disposed on a second support that is adjacent to the lower surface of the first support, wherein each of the plurality of light emitters is configured to illuminate one or more locations of the light-absorbing material on the lower surface of the first support; and wherein the first support and the second support are separated by a temperature-regulating air-gap between the lower surface of the first support and an upper surface of the second support.

19. The apparatus of claim 18, wherein at least a portion of the upper surface of the first support is configured as a seating region configured to removably seat a DMF cartridge.

20. The apparatus of claim 18, further comprising a second air gap configured to hold the droplet adjacent to the upper surface of the first support.

21. The apparatus of claim 18, wherein each one of the plurality of light emitters is paired with one of the plurality of thermal sensors, wherein each thermal detector of the plurality is configured to detect a temperature of the one or more locations on the lower surface of the first support illuminated by a respective paired light emitter of the plurality.

22. A digital microfluidic (DMF) apparatus, comprising:

a first support having an upper surface and a lower surface;

wherein the upper surface comprises a plurality of electrowetting drive electrodes;

wherein the lower surface comprises a plurality light-absorbing regions;

wherein each light absorbing region is thermally coupled to one or more regions of the upper surface by one or more thermally conductive vias;

a plurality of light emitters disposed beneath the first support and separated from the first support by an air gap, wherein each light emitter of the plurality of light emitters are configured to emit light into the air gap to heat one or more light-absorbing regions;

a plurality of thermal sensors; and a controller configured to receive input from each thermal sensor of the plurality of thermal sensors and to control the light emitted by one or more of the plurality of light emitters to regulate a temperature of one or more of the one or more regions of the upper surface.

* * * * *